US010106355B2

(12) United States Patent
Sato

(10) Patent No.: US 10,106,355 B2
(45) Date of Patent: Oct. 23, 2018

(54) SHEET CONVEYING APPARATUS AND IMAGE FORMING APPARATUS

(71) Applicant: CANON KABUSHIKI KAISHA, Tokyo (JP)

(72) Inventor: Kengo Sato, Koshigaya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/478,479

(22) Filed: Apr. 4, 2017

(65) Prior Publication Data

US 2017/0291782 A1 Oct. 12, 2017

(30) Foreign Application Priority Data

Apr. 11, 2016 (JP) ..... 2016-078998

(51) Int. Cl.

*B65H 9/00* (2006.01)
*B65H 5/06* (2006.01)
*B65H 85/00* (2006.01)
*B65H 7/00* (2006.01)

(52) U.S. Cl.

CPC ..... *B65H 9/004* (2013.01); *B65H 5/062* (2013.01); *B65H 7/00* (2013.01); *B65H 9/006* (2013.01); *B65H 85/00* (2013.01); *B65H 2511/11* (2013.01); *B65H 2513/50* (2013.01); *B65H 2513/51* (2013.01); *B65H 2801/06* (2013.01)

(58) Field of Classification Search

CPC ..... B65H 9/004; B65H 9/006; B65H 85/00; B65H 2511/11; B65H 2513/50; B65H 2513/51

See application file for complete search history.

(56) References Cited

U.S. PATENT DOCUMENTS

| | | | | |
|---|---|---|---|---|
| 5,154,411 | A | 10/1992 | Saito et al. | |
| 5,481,336 | A | 1/1996 | Tachibana et al. | |
| 6,487,379 | B2 | 11/2002 | Sato | |
| 6,581,922 | B2 | 6/2003 | Kuwata et al. | |
| 6,674,976 | B2 | 1/2004 | Sato et al. | |
| 6,785,478 | B2 | 8/2004 | Takahashi et al. | |
| 9,632,471 | B2 | 4/2017 | Sato et al. | |
| 2008/0054553 | A1* | 3/2008 | Muneyasu | B65H 9/004 271/240 |

FOREIGN PATENT DOCUMENTS

| | | |
|---|---|---|
| JP | 11-79474 A | 3/1999 |

* cited by examiner

*Primary Examiner* — David H Bollinger
(74) *Attorney, Agent, or Firm* — Fitzpatrick, Cella, Harper & Scinto

(57) ABSTRACT

A sheet conveying apparatus includes: a first pair of conveying rollers for conveying a sheet; a second pair of conveying rollers against which the leading edge of the sheet conveyed by the first pair of conveying rollers is hit and which conveys the sheet together with the first pair of conveying rollers by rotating after a loop is formed on the sheet; a separating portion for separating the first pair of conveying rollers; a first conveyance path for guiding the sheet; a second conveyance path which is a path different from the first conveyance path and guides the sheet; and a controller which changes a separation timing at which the first pair of conveying rollers is separated after the loop is formed on the sheet, depending on whether the sheet is guided by the first conveyance path or by the second conveyance path.

20 Claims, 18 Drawing Sheets

SHEET CONVEYING APPARATUS AND IMAGE FORMING APPARATUS

BACKGROUND OF THE INVENTION

Field of the Invention

The present invention relates to a sheet conveying apparatus that performs skew correction of a sheet, and to an image forming apparatus including the same.

Description of the Related Art

Recently, image quality is desired to be improved in image forming apparatuses such as copying machines, printers, and facsimiles. For this reason, improvement against image position deviation due to skew feeding or turning (sector) in sheet conveyance is particularly required.

For example, a leading edge of a sheet fed out from a sheet feeding apparatus is hit against a pair of registration rollers whose rotation has been stopped, and in that state, a pair of pre-registration rollers are driven to further feed the sheet to form a loop in order to correct the skew feeding of the sheet is generally known.

However, in this conventional configuration, there is a risk that the sheet whose skew feeding has been corrected by the pair of registration rollers and the pair of pre-registration rollers may be stressed by the pair of registration rollers and the pair of pre-registration rollers, and wrinkles or the like may occur. In order to prevent this, a configuration has been proposed in which the pair of pre-registration rollers is separated so as to release the nipping on the sheet by the pair of pre-registration rollers after correcting the skew feeding of the sheet as described above (Japanese Patent Laid-Open No. 11-79474).

However, depending on the configuration of the conveyance path of the sheet, in the case where the pair of pre-registration rollers is separated immediately after the skew correction, the influence of the conveyance resistance due to the slide friction between the sheet and the conveyance guide for guiding the sheet may become large. In this case, there is a possibility to cause skew feeding or turning of the sheet due to the conveyance resistance so as to worsen the image position deviation or to deteriorate the sheet conveyance to cause wrinkles, scratches, sheet jams, and the like.

SUMMARY OF THE INVENTION

Accordingly, it is desirable to suppress the skew feeding and turning of the sheet after the skew correction, and to prevent wrinkles, scratches, sheet jams, and the like of the sheet according to the present invention.

In order to solve the above issue, there is provided a sheet conveying apparatus including: a first pair of conveying rollers which conveys a sheet; a second pair of conveying rollers against which a leading edge of the sheet conveyed by the first pair of conveying rollers is hit so that a loop is formed on the sheet, the second pair of conveying rollers conveying the sheet together with the first pair of conveying rollers by rotating after the loop is formed on the sheet; a separating portion which separates the first pair of conveying rollers from each other; a first conveyance path which guides the sheet toward the first pair of conveying rollers; a second conveyance path which is a path different from the first conveyance path and guides the sheet toward the first pair of conveying rollers; and a controller which changes a separation timing at which the first pair of conveying rollers is separated after the loop is formed on the sheet, depending on whether the sheet is guided by the first conveyance path or by the second conveyance path.

Further features of the present invention will become apparent from the following description of exemplary embodiments with reference to the attached drawings.

DESCRIPTION OF THE EMBODIMENTS

Exemplary embodiments of the present invention will be described in detail below with reference to the accompanying drawings. However, the dimensions, materials, shapes, relative arrangements thereof and the like of the components described in the following embodiments should be appropriately changed according to the configurations and various conditions of apparatuses to which the present invention is applied, and the scope of the present invention is not intended to be limited only to these embodiments.

[First Embodiment]

(1) Image Forming Apparatus

Figure 1:
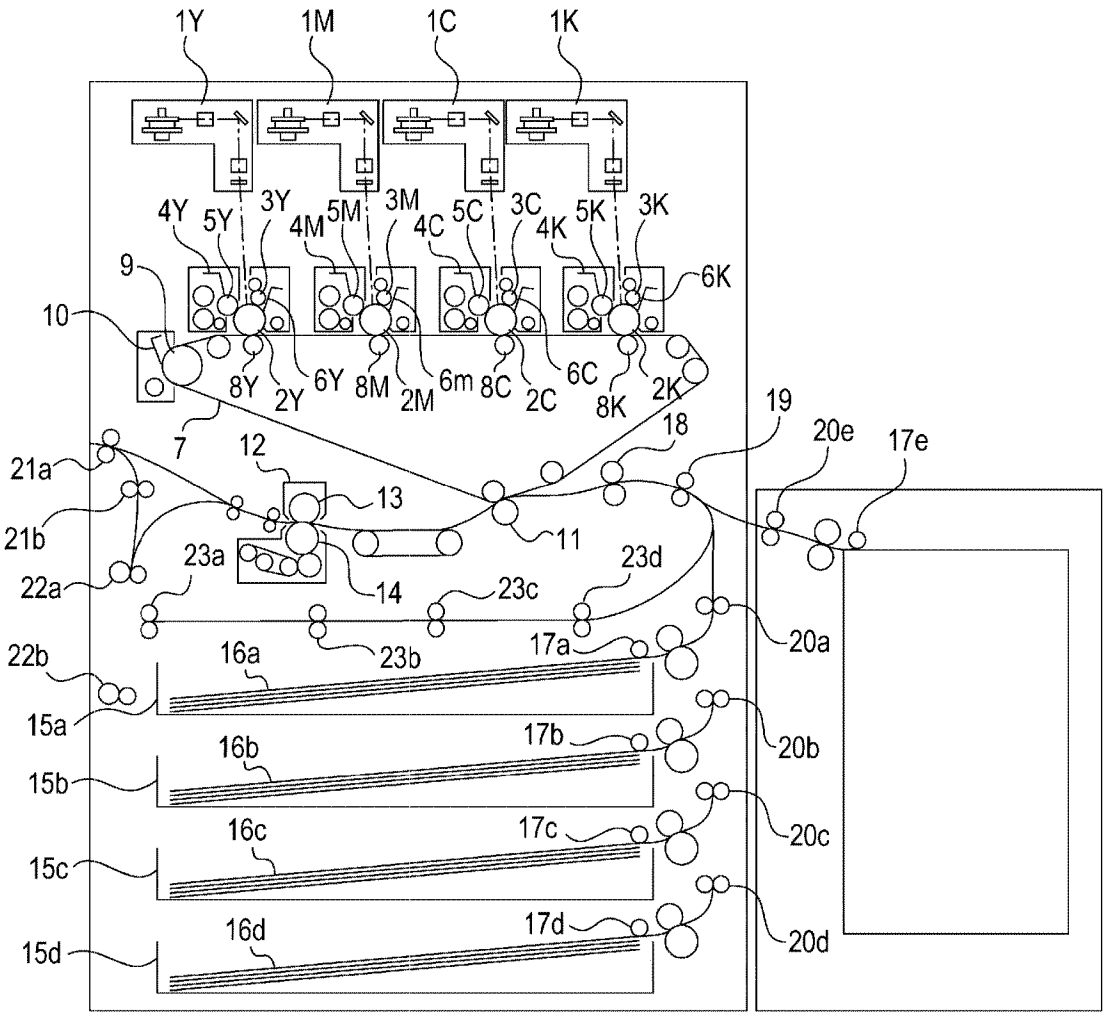
FIG. 1 is a cross-sectional view of an image forming apparatus according to a first embodiment.

First, with reference to FIG. 1, the configuration of an image forming apparatus having a sheet conveying apparatus according to the present embodiment will be briefly described. FIG. 1 is a schematic cross-sectional view showing an example of a configuration of a color image forming apparatus as an image forming apparatus provided with a sheet conveying apparatus in the present embodiment.

FIG. 1 shows laser scanner portions 1Y, 1M, 1C and 1K. Further, FIG. 1 shows photosensitive drums 2Y, 2M, 2C and 2K, charging rollers 3Y, 3M, 3C and 3K, development devices 4Y, 4M, 4C and 4K, developing sleeves 5Y, 5M, 5C and 5K, and cleaner portions 6Y, 6M, 6C and 6K of the photosensitive drums. Still further, FIG. 1 shows an intermediate transfer belt 7, primary transfer rollers 8Y, 8M, 8C and 8K, an intermediate transfer belt driving roller 9, a cleaner portion 10 of the intermediate transfer belt, and a secondary transfer roller 11. In addition, a fixing portion 12, a fixing roller 13, and a pressure roller 14 are shown. With these members, an image forming portion that forms an image on a transfer material as a sheet is configured. FIG. 1 further shows main body sheet-feeding cassettes 15*a*, 15*b*, 15*c* and 15*d*, an optional sheet-feeding cassette 15*e*, transfer materials 16*a*, 16*b*, 16*c*, 16*d* and 16*e*, and sheet feeding rollers 17*a*, 17*b*, 17*c*, 17*d* and 17*e*. A pair of registration rollers 18 as a second pair of conveying rollers, and a pair of pre-registration rollers 19 as a first pair of conveying rollers are shown. Further pairs of intermediate conveying rollers 20*a*, 20*b*, 20*c* and 20*d*, pairs of discharge rollers 21*a* and 21*b*, pairs of duplex conveying rollers 23*a*, 23*b*, 23*c* and 23*d* are shown.

Next, the image forming operation of the color image forming apparatus having the above-described configuration will be described.

Each of the photosensitive drums 2Y, 2M, 2C and 2K is configured by applying an organic photoconductive layer on the outer periphery of an aluminum cylinder, and is rotated by transmission of the driving force of a driving motor (not shown). The driving motor rotates the photosensitive drums 2Y, 2M, 2C and 2K in the counterclockwise direction in FIG. 1 in accordance with the image forming operation. Exposure light to the photosensitive drums 2Y, 2M, 2C and 2K is emitted from the laser scanner portions 1Y, 1M, 1C and 1K. The laser scanner portions 1Y, 1M, 1C and 1K selectively perform exposure on the surfaces of the photosensitive drums 2Y, 2M, 2C and 2K based on image data sent from a controller (not shown). As a result, electrostatic latent images based on the image data are formed on the surfaces of the photosensitive drums 2Y, 2M, 2C and 2K.

The charging rollers 3Y, 3M, 3C, and 3K for charging the photosensitive drums of yellow (Y), magenta (M), cyan (C) and black (K) are provided as primary charging portions in image forming portions of respective colors.

In order to visualize the formed electrostatic latent image, the development devices 4Y, 4M, 4C and 4K that develops yellow (Y), magenta (M), cyan (C), and black (K) images are provided in respective color image forming portions as developing portions. The developing sleeves (developer carriers) 5Y, 5M, 5C and 5K that convey the developers to the respective color photosensitive drums 2Y, 2M, 2C and 2K are provided in the respective development devices.

On the other hand, the intermediate transfer belt 7 is in contact with the photosensitive drums 2Y, 2M, 2C and 2K, rotates in the clockwise direction in FIG. 1 via the intermediate transfer belt driving roller 9 during color image formation, and accepts the transfer of visible images in accordance with rotation of the photosensitive drums 2Y, 2M, 2C and 2K. Further, at the time of image formation, the secondary transfer roller 11 which will be described later, comes in contact with the intermediate transfer belt 7 to nip and convey the transfer material 16. At the secondary transfer portion where the intermediate transfer belt 7 and the secondary transfer roller 11 face each other, color visible images superposed on each other on the intermediate transfer belt 7 are simultaneously transferred onto the transfer material 16. While the color visible images on the intermediate transfer belt 7 are transferred in a superposed state, the secondary transfer roller 11 is in contact with the intermediate transfer belt 7 but separated from the intermediate transfer belt 7 at the end of the printing process.

The fixing portion 12 fixes the transferred color visible images on the transfer material 16 while conveying the transfer material 16. As illustrated in FIG. 1, the fixing portion 12 includes the fixing roller 13 that heats the transfer material 16, and the pressure roller 14 that presses the transfer material 16 against the fixing roller 13. The fixing roller 13 is formed in a hollow shape and has a built-in heater (not shown) inside. That is, the transfer material 16 having the color visible images is conveyed by the fixing roller 13 and the pressure roller 14, and at the same time, color visible images by the toner are fixed on the surface by applying heat and pressure.

After the image forming operation is completed, the cleaner portions 6Y, 6M, 6C and 6K of the photosensitive drums clean the toner remaining on the photosensitive drums 2Y, 2M, 2C and 2K, and the cleaner portion 10 of the intermediate transfer belt cleans the toner remaining on the intermediate transfer belt 7. The residual toner after the visible images by the toner formed on the photosensitive drums 2Y, 2M, 2C and 2K are transferred to the intermediate transfer belt 7, or after four color visible images formed on the intermediate transfer belt 7 are transferred to the transfer material 16 is stored in a cleaner container (not shown).

Next, the sheet conveyance operation of the color image forming apparatus will be described.

The transfer material 16 as a sheet is conveyed one by one from any one of the main body sheet-feeding cassettes 15*a*, 15*b*, 15*c* and 15*e*, and the optional sheet-feeding cassette 15*d* by using anyone of the sheet feeding rollers 17*a*, 17*b*, 17*c*, 17*d* and 17*e* including the sheet separation portion.

Then, the transfer material 16 is fed into the pair of pre-registration rollers 19 and the pair of registration rollers 18 by the pairs of intermediate conveying rollers 20*a*, 20*b*, 20*c*, 20*d* and 20*e*. The skew correction of the transfer material by the pair of pre-registration rollers 19 and the pair of registration rollers 18 will be described later. The pair of registration rollers 18 feeds the transfer material 16 to the secondary transfer roller 11 in synchronism with the exposure of the laser scanner portions 1Y, 1M, 1C, and 1K. As described above, by nipping and conveying the transfer material 16 with the secondary transfer roller 11, the color visible images on the intermediate transfer belt 7 are transferred to the transfer material 16 in a superposed state. Then, the transferred color visible images are fixed on the transfer material 16 while the transfer material 16 is conveyed in the fixing portion 12. Thereafter, the transfer material 16 is discharged to the outside of the main body by the pair of discharge rollers 21*a*, or delivered to a sheet processing apparatus (not shown), and the printing operation is ended.

When being discharged straight, the transfer material 16 is delivered to the pair of discharge rollers 21*a* after passing through the fixing portion 12. When the transfer material 16 is inverted and then discharged, the transfer material 16 is transferred to the pair of inversion rollers 22*a* after passing through the fixing portion 12. The pair of inversion rollers 22*a* can rotate forward and backward, and is driven to rotate reversely after receiving the transfer material 16 from the fixing portion 12 so that the transfer material 16 is delivered to the pairs of discharge rollers 21*a* and 21*b*, and is discharged to the outside of the main body or delivered to a sheet processing apparatus (not shown) in an inverted state. According to the setting of the straight discharge, inversion discharge, the switching portion such as a flapper (not shown) switches the sheet conveyance paths for delivering the material to the pair of discharge rollers 21*a* or the pair of inversion rollers 22*a*.

In the case of duplex printing of the transfer material 16, after passing through the fixing portion 12, the transfer material 16 is delivered to the pairs of inversion rollers 22*a* and 22*b*. The pairs of inversion rollers 22*a* and 22*b* can rotate forward and backward and at the time of duplex printing, the transfer material 16 is conveyed to the pair of inversion rollers 22*b*, and then the pair of inversion rollers 22*b* is driven to rotate in reverse so that the transfer material 16 is conveyed to the pairs of duplex conveying rollers 23*a*, 23*b*, 23*c* and 23*d*. The pairs of duplex conveying rollers 23*a*, 23*b*, 23*c* and 23*d* feed the transfer material 16 again to the pair of pre-registration rollers 19 and the pair of registration rollers 18, and the color visible images are again transferred on the back surface side of the transfer material 16 in a superposed state by the secondary transfer roller 11 so that duplex printing is performed. In accordance with the settings of inversion discharge and duplex printing, sheet conveyance paths for delivery to the pairs of discharge rollers 21*a* and 21*b* and pairs of duplex conveying rollers 23*a*, 23*b*, 23*c*, 23*d* are switched by a switching portion such as a flapper (not shown). After the color visible image is transferred onto the transfer material 16 by the secondary transfer roller 11, the color visible image is fixed on the transfer material 16 at the fixing portion 12. Thereafter, the transfer material 16 is discharged out of the main body by the pair of discharge rollers 21*a*, or delivered to a sheet processing apparatus (not shown), and the duplex printing operation is ended.

Straight discharge, inversion discharge, and duplex printing can be freely set for the print job.

(2) Sheet Conveyance Path

Figure 2:
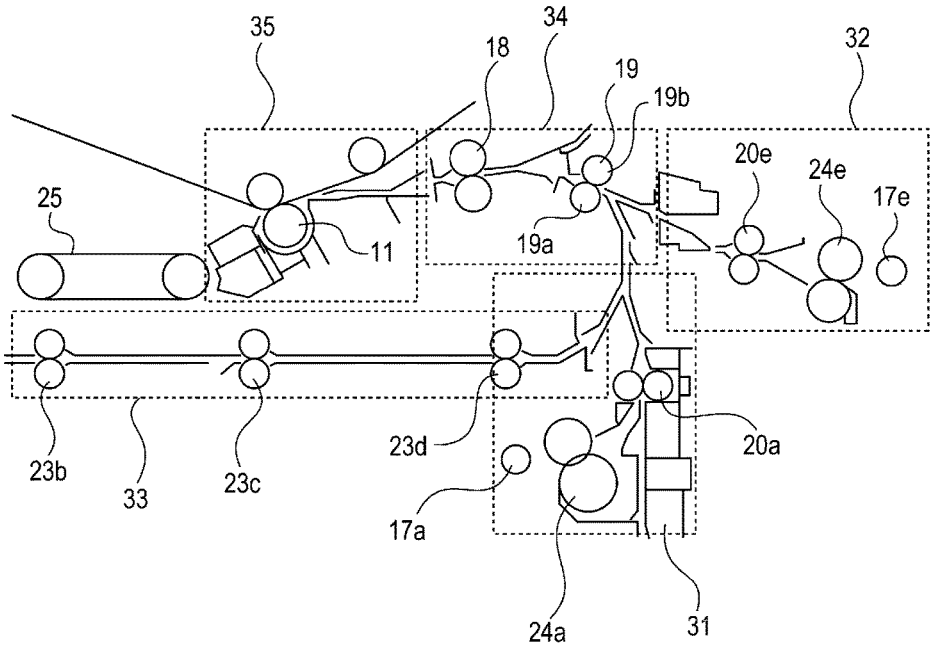
FIG. 2 is a detailed view of a sheet conveyance path of the image forming apparatus according to the first embodiment.

Next, with reference to FIG. 2, the sheet conveying apparatus and the sheet conveyance path in the image forming apparatus according to the present embodiment will be described. FIG. 2 is a cross-sectional view showing in more detail the configuration of the sheet conveyance path of the color image forming apparatus described with reference to FIG. 1 in the previous section.

The image forming apparatus according to the present embodiment includes a sheet conveying apparatus having the following configuration. As shown in FIG. 2, the sheet conveying apparatus makes a loop by bringing the leading edge of the transfer material conveyed by the pair of pre-registration rollers 19 into contact with the nip portion of the pair of registration rollers 18 whose rotation has been stopped to correct the sheet skew feeding. The pair of registration rollers 18 is the second pair of conveying rollers provided on the downstream side of the pair of pre-registration rollers 19 which is the first pair of conveying rollers in the conveyance direction of the transfer material. The sheet conveying apparatus includes a separating portion (FIG. 6) for separating the pair of pre-registration rollers 19 from each other, a first conveyance path and a second conveyance path which will be described below. Here, as the first conveyance path, a main body sheet-feeding conveyance portion 31 and an optional sheet-feeding conveyance portion 32 used as sheet-feeding conveyance paths are exemplified. In addition, a duplex conveyance portion 33 used as a duplex conveyance path is exemplified as the second conveyance path.

FIG. 2 shows the main body sheet-feeding conveyance portion 31, the optional sheet-feeding conveyance portion 32, the duplex conveyance portion 33, a registration corrector portion 34, a secondary transfer portion 35, pairs of sheet-feeding separation rollers 24*a* and 24*e*, and a pre-fixing conveyance belt 25.

The main body sheet-feeding conveyance portion 31 and the optional sheet-feeding conveyance portion 32 are first conveyance paths for conveying and guiding the transfer material 16 from a freely selected sheet-feeding cassette. The main body sheet-feeding conveyance portion 31 and the optional sheet-feeding conveyance portion 32 each have at least one of the pairs of conveying rollers 20*a* and 20*e*, and convey and guide a sheet toward the pair of pre-registration rollers 19. The transfer materials 16 are fed from the selected sheet-feeding cassette by the sheet feeding rollers 17*a* and 17*e*, and are separated one by one by the pairs of sheet-feeding separation rollers 24*a* and 24*e*. The separated transfer material is conveyed to the registration corrector portion 34 by the pairs of intermediate conveying rollers 20*a* and 20*e*. The main body sheet-feeding cassettes 15*b*, 15*c* and 15*d* described with reference to FIG. 1 have similar configurations as the main body sheet-feeding cassette 15*a*, and therefore description thereof is omitted. The duplex conveyance portion 33 is the second conveyance path for conveying and guiding the transfer material 16 inverted after one-side printing to the image forming portion again when duplex printing is set. The duplex conveyance portion 33 has at least one pair of conveying rollers 23*d* and guides and conveys the transfer material to the pair of pre-registration rollers 19 via a path different from the main body sheet-feeding conveyance portion 31 and the optional sheet-feeding conveyance portion 32. The registration corrector portion 34 corrects the skew feeding of the transfer material 16 generated at the time of feeding or conveying the transfer material 16 and conveys the transfer material 16 to the secondary transfer portion 35. The transfer material 16 to which the color visible image has been transferred at the secondary transfer portion is then delivered to the pre-fixing conveyance belt 25 that conveys the transfer material 16 to the fixing portion 12.

According to the present embodiment, the separation timing of the pair of pre-registration rollers 19 is optimized (changed) according to the conveyance paths of the main body sheet-feeding conveyance portion 31, the optional sheet-feeding conveyance portion 32, the duplex conveyance portion 33, for example. Details will be described later.

(3) Registration Correction

Next, with reference to FIGS. 3 to 5, skew correction (registration correction) of the sheet by the sheet conveying apparatus according to the present embodiment will be described. FIG. 3 is an illustration of image position deviation that occurs in the secondary transfer portion 35 when the transfer material 16 is conveyed while being skewed or conveyed with rotation. FIGS. 4 and 5 are illustrations of the skew correction operation in the registration corrector portion 34.

Figure 3A:
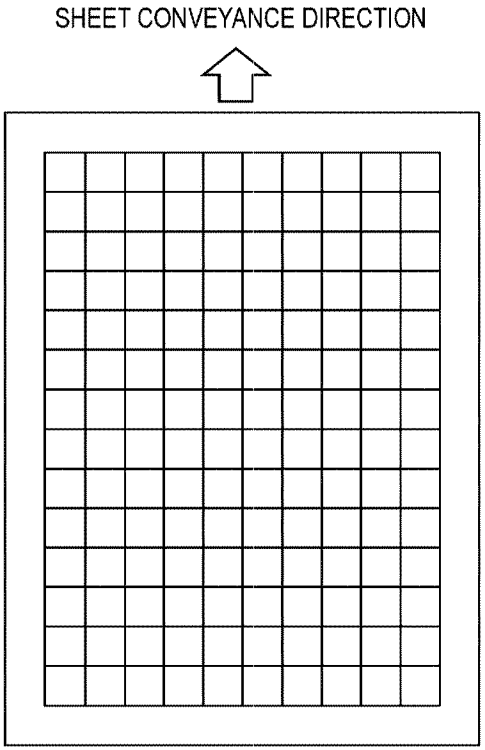
FIGS. 3A, 3B and 3C are illustrations of image position deviation according to the first embodiment.
Figure 3B:
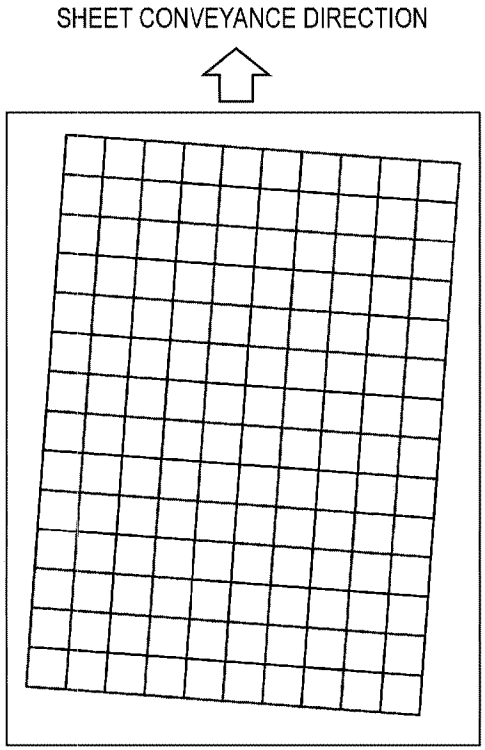
Figure 3C:
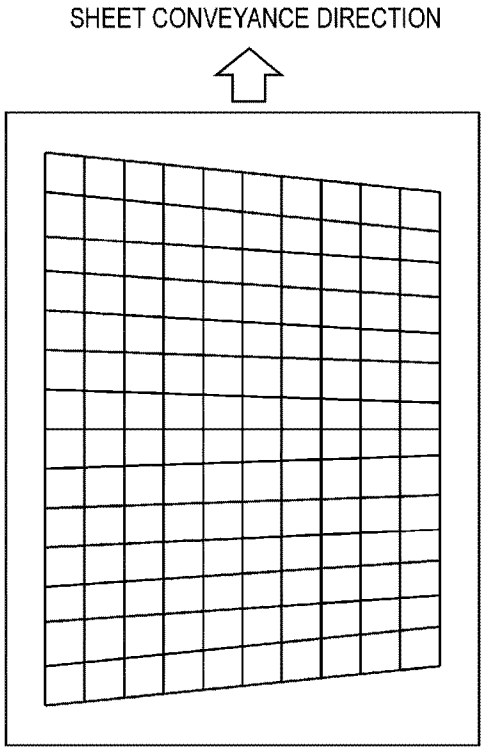

There is a case that the transfer material is conveyed while being skewed or with rotation due to misalignment of the pair of conveying rollers or unbalanced pressure between the pair of conveying rollers during feeding or conveying of the transfer material 16. Essentially, it is ideal that the transfer material 16 is conveyed straight in the secondary transfer portion 35, and when the transfer material 16 is conveyed straight, the image can be transferred to an accurate position with respect to the transfer material 16 as shown in FIG. 3A. However, when the transfer material 16 is conveyed while being skewed in the secondary transfer portion 35, the image is obliquely transferred to the transfer material 16 as shown in FIG. 3B. In addition, when the transfer material 16 is conveyed with rotation in the secondary transfer portion 35, the image is transferred while rotating with respect to the transfer material 16 and the image squareness will be impaired as shown in FIG. 3C. In order to suppress skew feeding and image position deviation from squareness, the registration corrector portion 34 corrects the straightness of the transfer material 16 and then delivers the transfer material 16 to the secondary transfer portion 35.

Figure 4A:
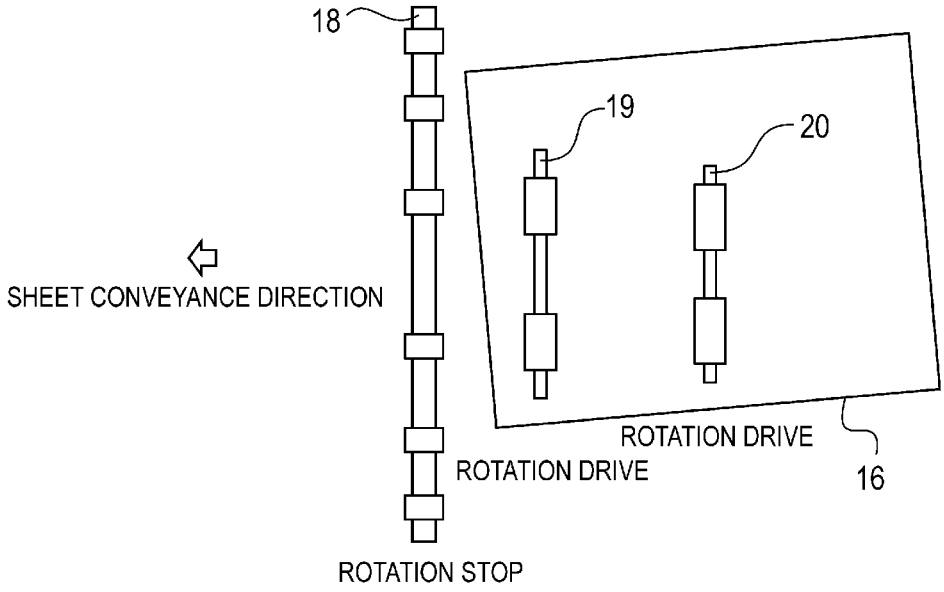
FIGS. 4A and 4B are illustrations of a skew correcting operation according to the first embodiment.
Figure 4B:
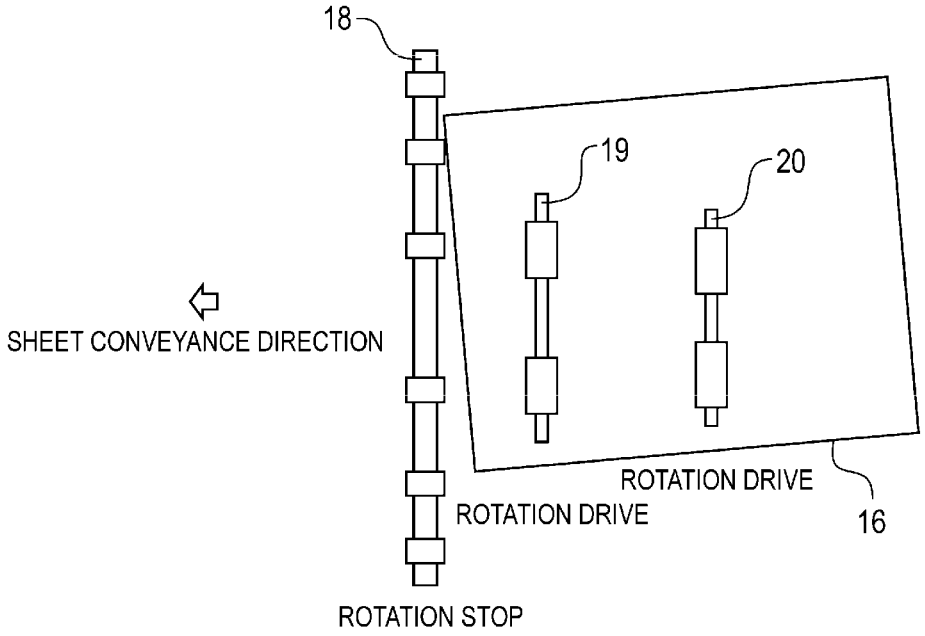
Figure 5A:
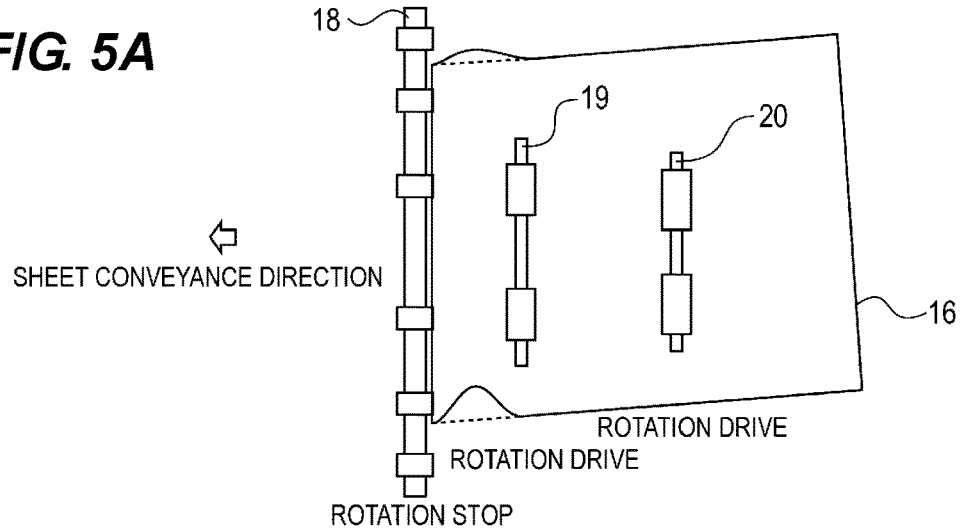
FIGS. 5A, 5B and 5C are illustrations of the skew correcting operation according to the first embodiment.
Figure 5B:
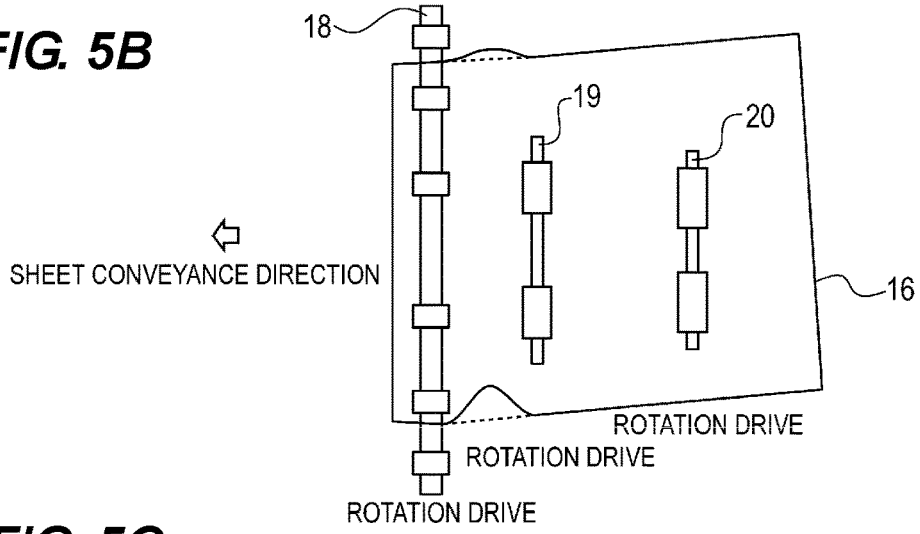

The skew correction of the transfer material 16 in the registration corrector portion 34 will be described in detail. As shown in FIG. 4A, even when the transfer material 16 is conveyed while being skewed to the registration corrector portion 34, the pair of pre-registration rollers 19 and a pair of intermediate conveying rollers 20 further feed the transfer material 16 to the pair of registration rollers 18 whose rotation has been stopped. As a result, the skew feeding is corrected so that the leading edge of the transfer material 16 follows the pair of registration rollers 18 as shown in FIGS. 4B and 5A. Then, the transfer material 16 is delivered to the secondary transfer portion 35 while being straight, as shown in FIG. 5B. A loop for skew correction is formed between the pair of registration rollers 18 and the pair of pre-registration rollers 19 while the skew feeding is corrected in the registration corrector portion 34 and the transfer material 16 is conveyed to the secondary transfer portion. The amount of loop formation of the transfer material 16 is determined by the feeding amount of the pair of pre-registration rollers 19 and the pair of intermediate conveying rollers 20 to the pair of registration rollers 18 whose rotation has been stopped, regarding the time point at which a timing detection sensor or the like detects the position of the transfer material 16 as the starting point. Although not shown, the timing detection sensor is provided just before the pair of registration rollers 18.

Figure 5C:
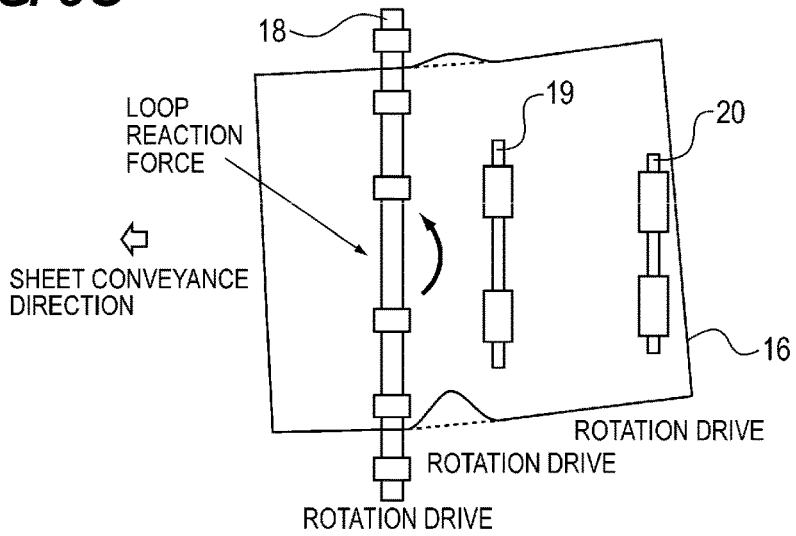

However, due to loop reaction force of the transfer material 16 formed between the pair of registration rollers 18 and the pair of pre-registration rollers 19, force for cancelling the correction of the skew feeding is generated on the transfer material 16. When the transfer material 16 continues to be conveyed while receiving the loop reaction force, the transfer material 16 may be skewed again or may be conveyed while being rotated as shown in FIG. 5C. In the case where the loop reaction force when the skew feeding is corrected in the registration corrector portion 34 is particularly large, wrinkles and scratches may occur on the transfer material 16 at the pair of registration rollers 18 and the secondary transfer roller 11, and further a sheet jam may also be caused. In order to suppress these phenomena, a configuration is used in which the nip portions of the pair of pre-registration rollers 19 are separated and the pressure is released when the transfer material is conveyed from the registration corrector portion 34 to the secondary transfer portion 35 in the present embodiment. In this manner, the loop reaction force of the transfer material 16 generated between the pair of registration rollers 18 and the pair of pre-registration rollers 19 can be reduced when the skew correction is performed, and the transfer material 16 can be conveyed further straight. The transfer material 16 is delivered straight from the registration corrector portion 34 to the secondary transfer portion 35 and is conveyed as it is, so that a color visible image can be transferred without the deviation of the image position with respect to the transfer material 16 as shown in FIG. 3A.

(4) Separating Configuration of Pair of Pre-Registration Rollers

Next, with reference to FIGS. 6 and 7, a description will be given of a separating configuration of the pair of pre-registration rollers 19 in the present embodiment. FIGS. 6 and 7 are schematic perspective views showing an example of a separating configuration of the pair of pre-registration rollers 19 in the present embodiment.

FIGS. 6 and 7 show a follower roller 19*b* of the pair of pre-registration rollers 19, a pressure spring 42 and a follower roller shaft 43. A pre-registration conveyance upper guide 44, a separating cam 45, a separating shaft 46, and a separating lever 47 are shown.

The follower roller 19*b* is made of a resin material such as POM, and a rubber roller (not shown) made of EPDM or urethane material (a driving roller 19*a* shown in FIG. 2) is provided on the opposing side, to form the pair of pre-registration rollers 19 as the first pair of conveying rollers. The follower roller 19*b* is pressurized by the pressure spring 42 to generate a nip pressure between the follower roller 19*b* and the opposed rubber roller, and nips and conveys the transfer material 16. The follower roller 19*b* is rotatably held by the follower roller shaft 43. A pre-registration conveyance upper guide 44 is disposed with a predetermined gap amount between the pre-registration conveyance upper guide 44 and a pre-registration conveyance lower guide (not shown), and defines a conveyance path for guiding the transfer material.

Figure 6A:
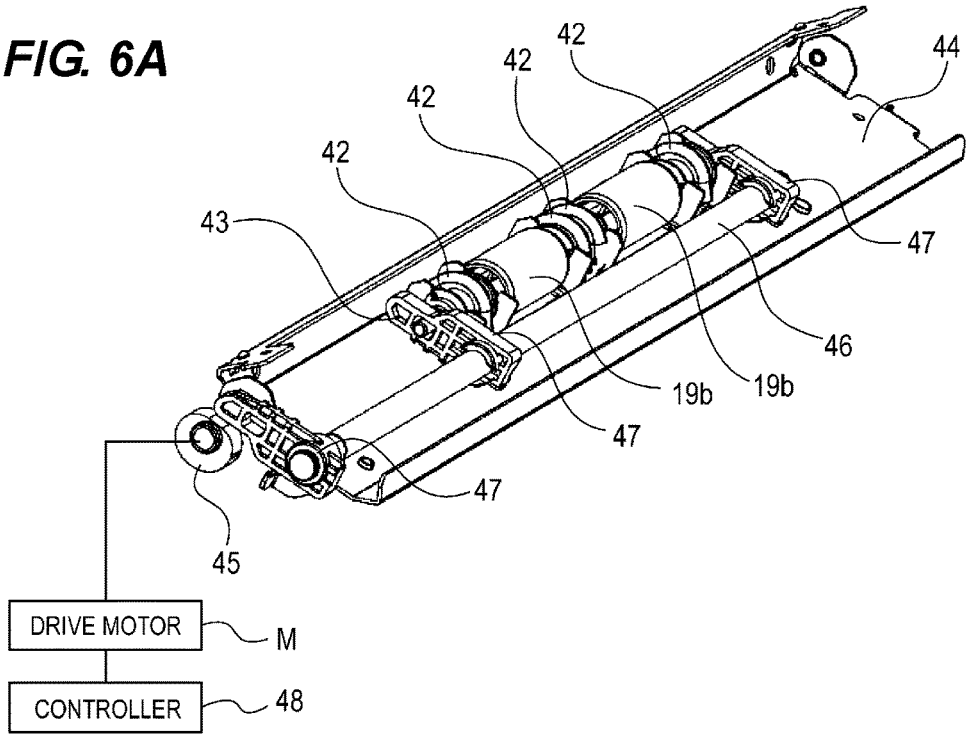
FIGS. 6A and 6B are illustrations of a separating configuration of pre-registration rollers according to the first embodiment.
Figure 6B:
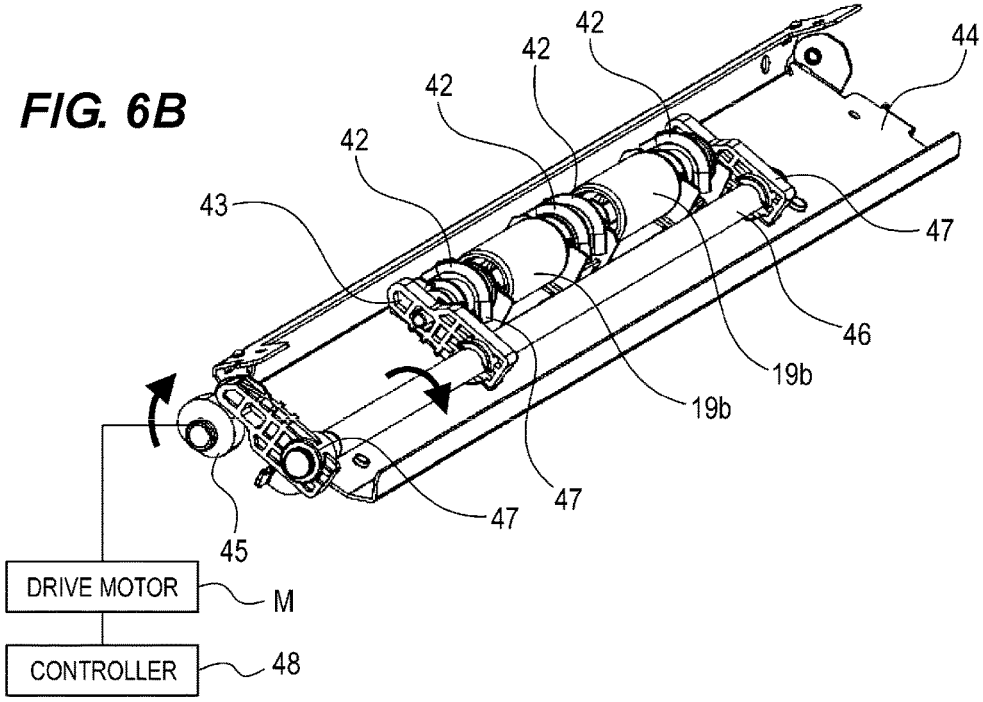
Figure 7A:
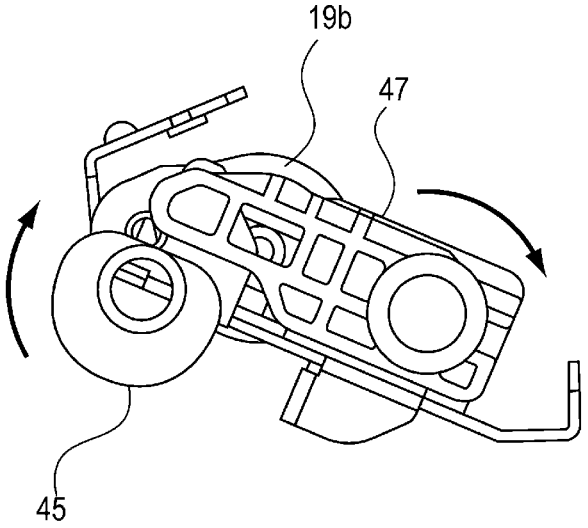
FIGS. 7A and 7B are illustrations of the separating configuration of the pre-registration rollers according to the first embodiment.
Figure 7B:
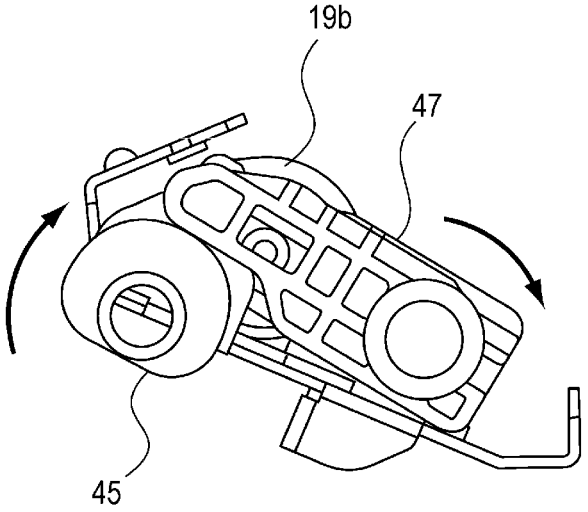

Next, the separating operation of the follower roller 19*b* of the pair of pre-registration rollers 19 will be described. FIGS. 6A and 7A show a state in which the follower roller 19*b* is in pressure contact with a rubber roller (not shown), and FIGS. 6B and 7B show a state in which the follower roller 19*b* is separated from the rubber roller (not shown).

The separating cam 45 is rotationally driven by a driving motor (driving portion) M. The separating lever 47 is held rotatably around the separating shaft 46 that is a rotation center. When the separating cam 45 rotates, the cam face presses the separating lever 47 to rotate the separating shaft 46 and the separating lever 47. The end of the separating lever 47 is in contact with the follower roller shaft 43. As the separating lever 47 rotates, the follower roller 19*b* and the follower roller shaft 43 are lifted above the pre-registration conveyance upper guide 44, and are separated from a rubber roller (not shown). When the separating cam 45 is further rotated, the pressing force to the separating lever 47 on the cam face is released, and the follower roller 19*b* is pressed against the rubber roller (not shown) again by the pressure spring 42. The separating cam 45, the separating shaft 46, the separating lever 47 and the driving motor M make up a separating portion for separating the follower roller of the pair of pre-registration rollers from the driving roller. It should be noted that the operation of pressing and separating the pair of pre-registration rollers 19 by the separating portion is controlled by a controller 48 which controls the operation of the apparatus.

(5) Separation Control of Pair of Pre-Registration Rollers

Figure 16:
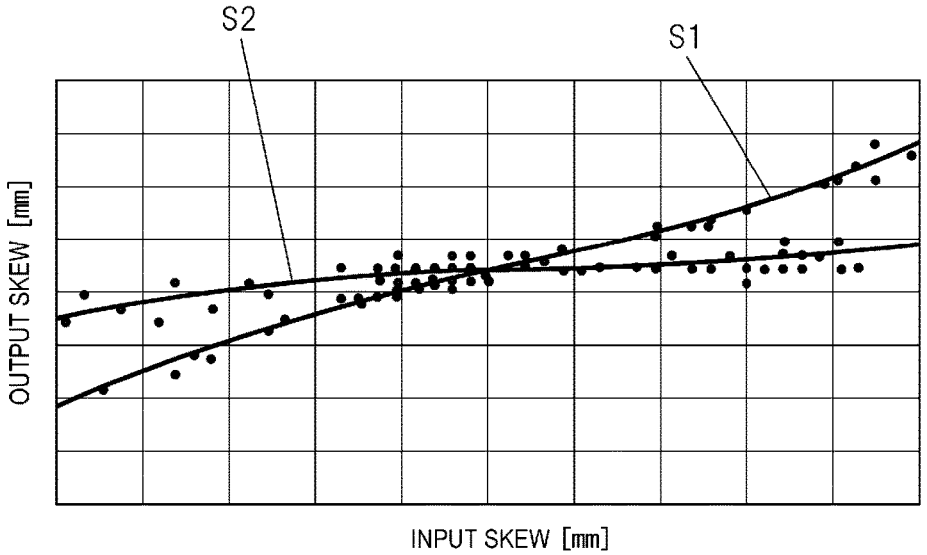
FIG. 16 is an illustration of skew feeding according to the first embodiment.
Figure 17:
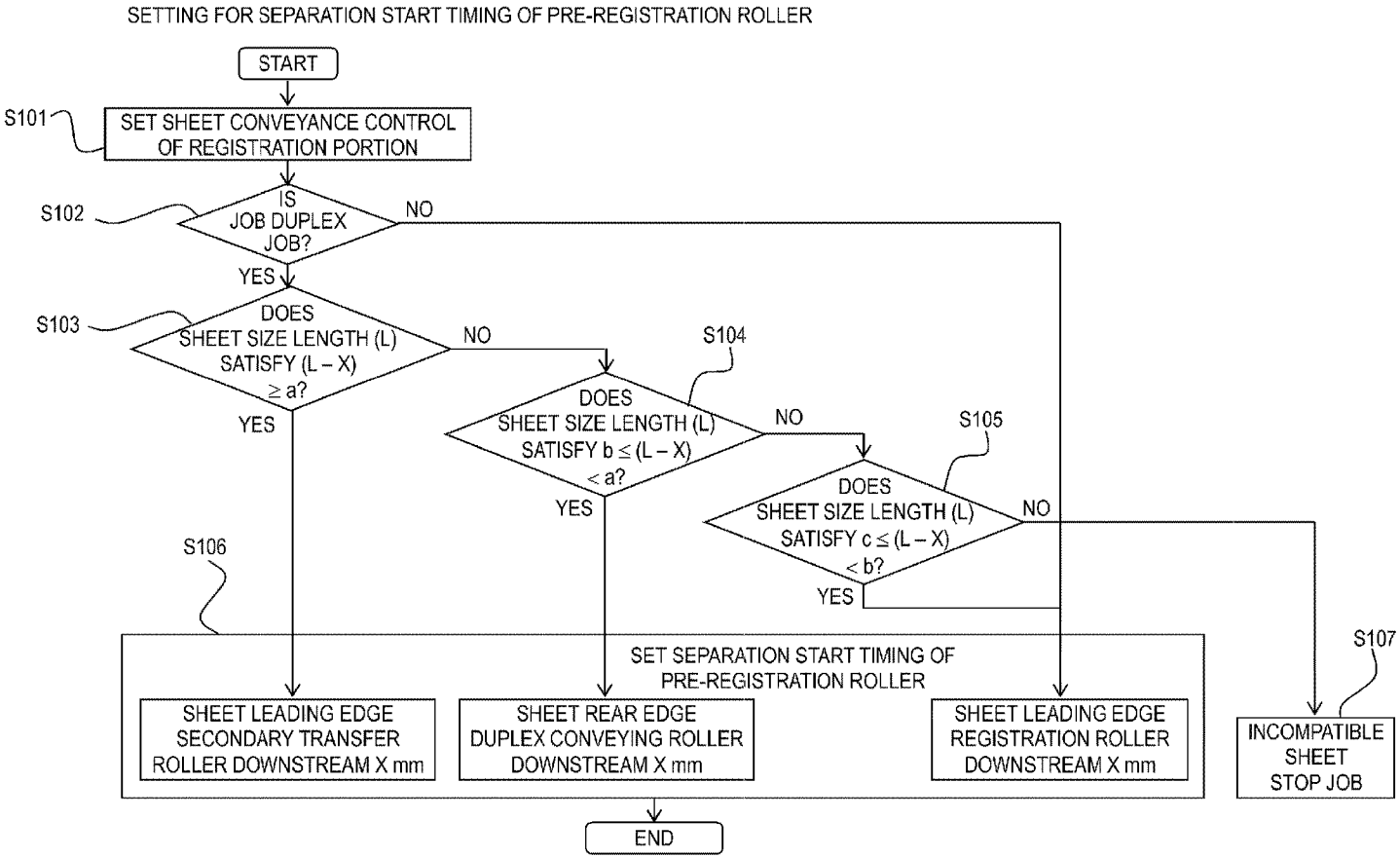
FIG. 17 is a flowchart of separation timing according to the first embodiment.
Figure 18:
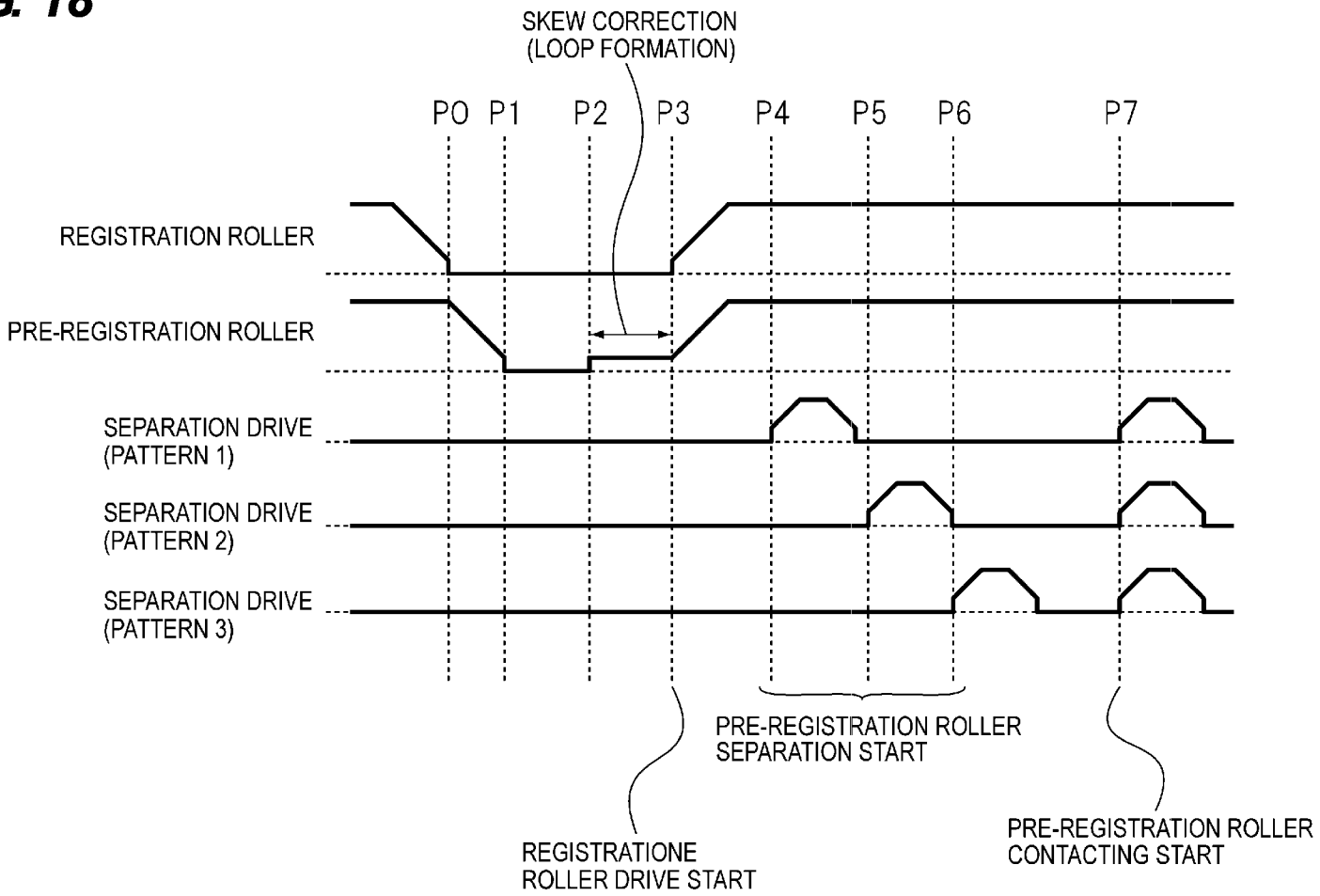
FIG. 18 is a sequence diagram of separation drive according to the first embodiment.

Next, with reference to FIGS. 8 to 18, the separation control of the pair of pre-registration rollers 19 according to the present embodiment will be described in detail. FIGS. 8 and 9 are illustrations of the conveyance operation when the transfer material 16 is conveyed from the main body sheet-feeding conveyance portion 31. FIGS. 10 and 11 are illustrations of the conveyance operation when the transfer material 16 is conveyed from the optional sheet-feeding conveyance portion 32. FIGS. 12 to 15 are illustrations of the conveyance operation when the transfer material 16 is conveyed from the duplex conveyance portion 33. FIG. 16 is an illustration of skew feeding of the transfer material 16 when the separation timing of the pair of pre-registration rollers 19 is optimized. FIG. 17 is a flow chart for determining the separation timing of the pair of pre-registration rollers 19 according to the conveyance path and the sheet size (the length of the sheet in the conveyance direction). FIG. 18 is a sequence diagram of separation drive of the pair of pre-registration rollers 19 determined according to the conveyance path and the sheet size.

Figure 8A:
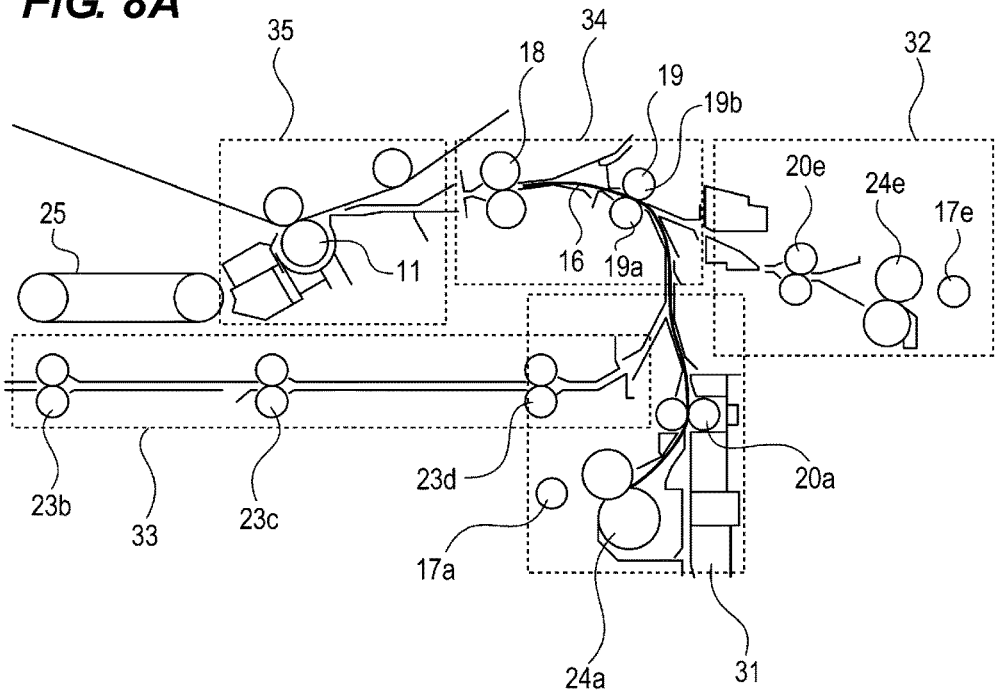
FIGS. 8A and 8B are illustrations of a sheet conveyance operation according to the first embodiment.
Figure 8B:
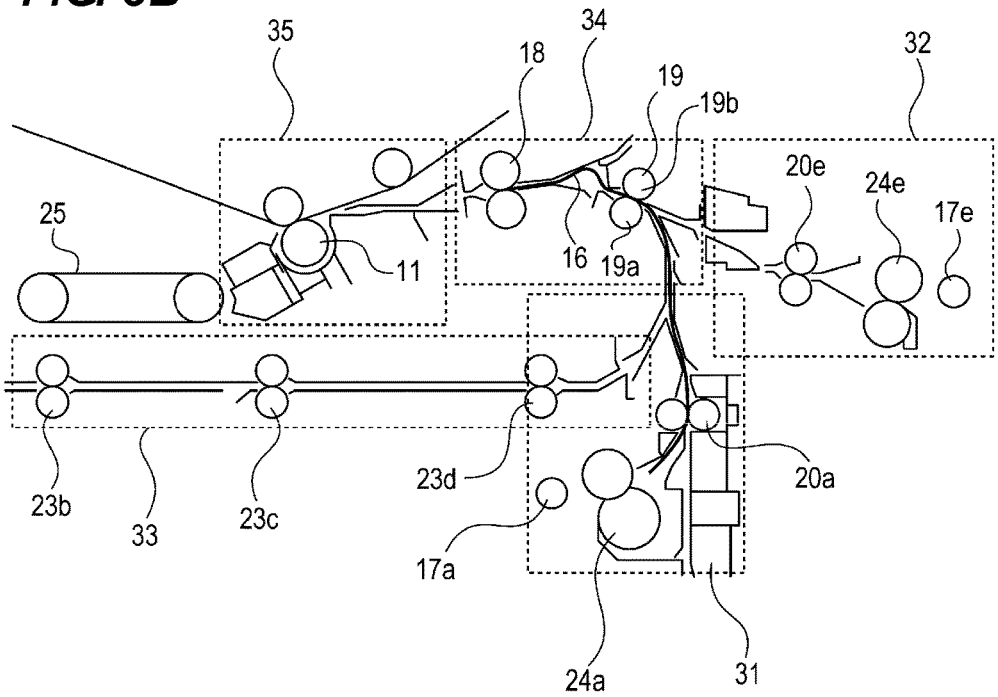
Figure 9A:
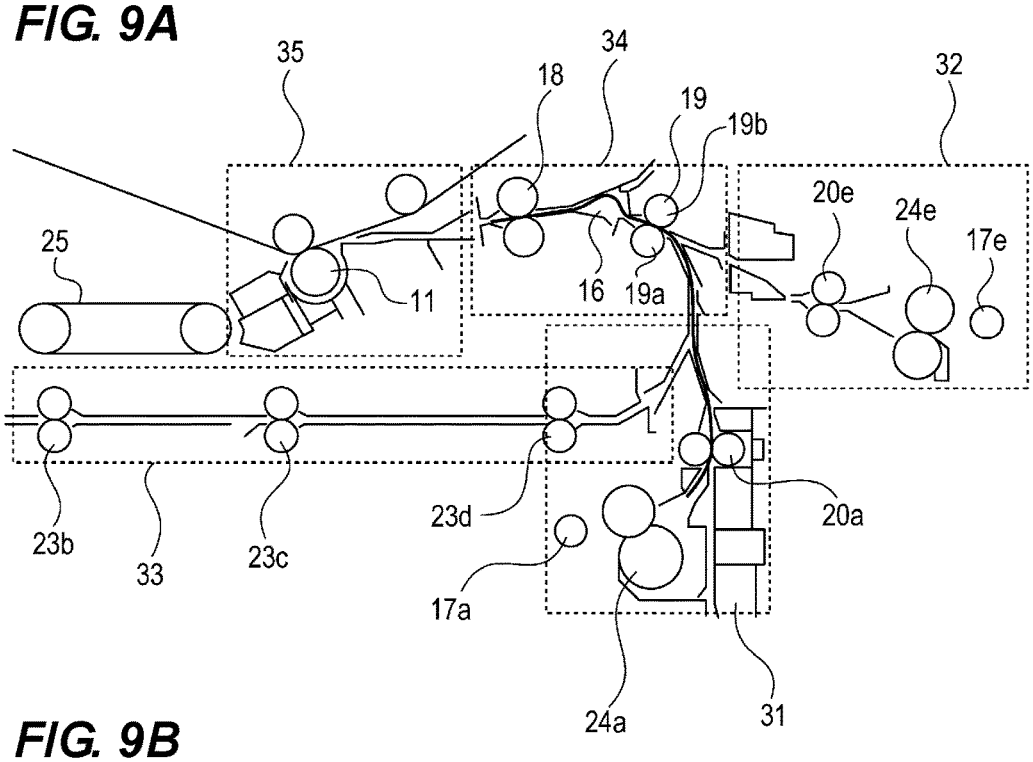
FIGS. 9A and 9B are illustrations of the sheet conveyance operation according to the first embodiment.
Figure 9B:
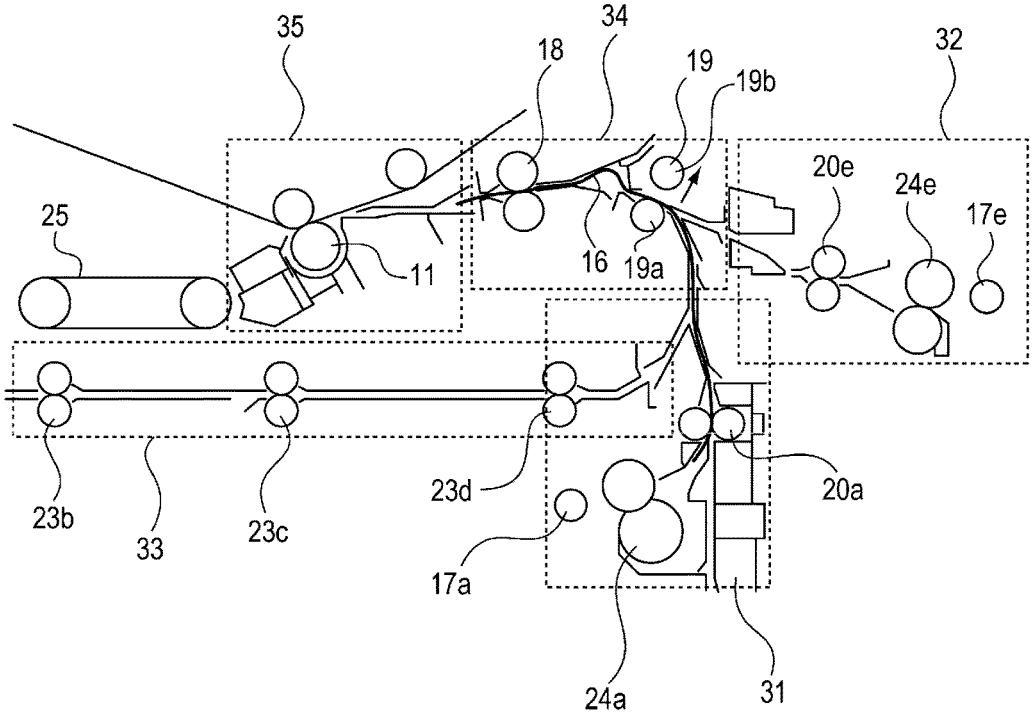

First, the case where the transfer material 16 is conveyed from the main body sheet-feeding conveyance portion 31 will be described in detail. As shown in FIG. 8A, when the transfer material 16 is conveyed to the registration corrector portion 34, a timing detection sensor (not shown) disposed immediately before the pair of registration rollers 18 whose rotation has been stopped detects the position of the transfer material. In accordance with the detected timing, a predetermined amount of feed is given to the transfer material 16 by the pair of pre-registration rollers 19 and the pair of intermediate conveying rollers 20*a*. As a result, as shown in FIG. 8B, a loop is formed between the pair of registration rollers 18 and the pair of pre-registration rollers 19 to correct the skew feeding of the transfer material 16. Thereafter, the pair of registration rollers 18, the pair of pre-registration rollers 19, and the pair of intermediate conveying rollers 20*a* are re-driven at the same time in synchronism with the exposure of the laser scanner portions 1Y, 1M, 1C and 1K, and feed the transfer material 16 to the secondary transfer roller 11. In synchronism with the exposures of the laser scanner portions 1Y, 1M, 1C, and 1K, the position of the leading edge of the image with respect to the transfer material 16 is set so as to secure a predetermined amount. As shown in FIG. 9A, the separating operation of the pair of pre-registration rollers 19 is started when the transfer material 16 has been conveyed for a distance of a predetermined amount X mm regardless of the length of the transfer material after the pair of registration rollers 18 is re-driven. Here, the predetermined amount X for conveying the transfer material for a distance of a predetermined amount is set to X=10 mm. Then, the transfer material 16 is conveyed to the secondary transfer portion 35 in the separated state of the pre-registration rollers as shown in FIG. 9B. This manner suppresses the influence of the loop reaction force of the transfer material 16 formed between the pair of registration rollers 18 and the pair of pre-registration rollers 19, so that conveyance is possible without the skew feeding, rotation, wrinkles and scratches of the transfer material.

Figure 10A:
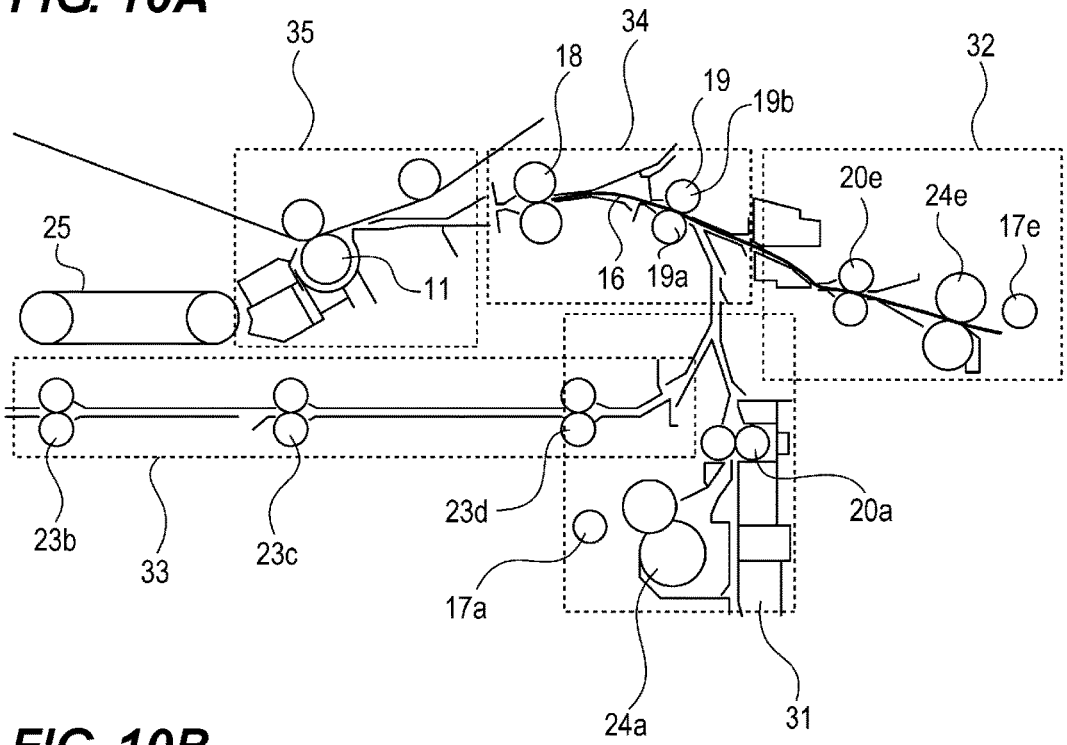
FIGS. 10A and 10B are illustrations of the sheet conveyance operation according to the first embodiment.
Figure 10B:
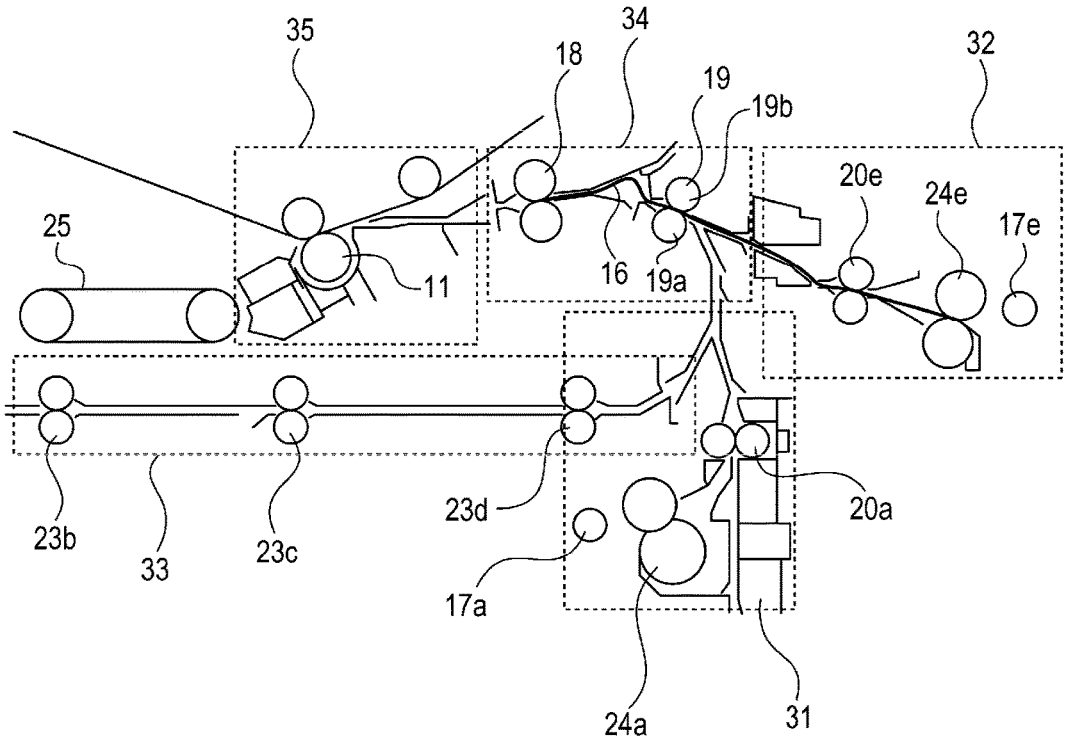
Figure 11A:
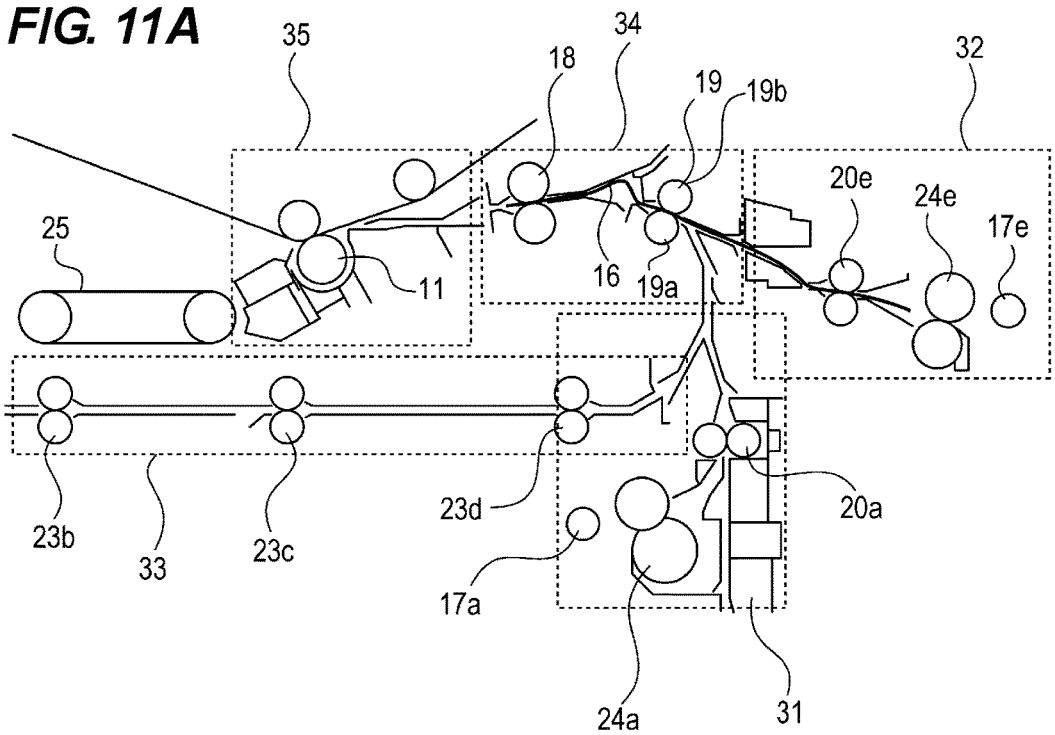
FIGS. 11A and 11B are illustrations of the sheet conveyance operation according to the first embodiment.
Figure 11B:
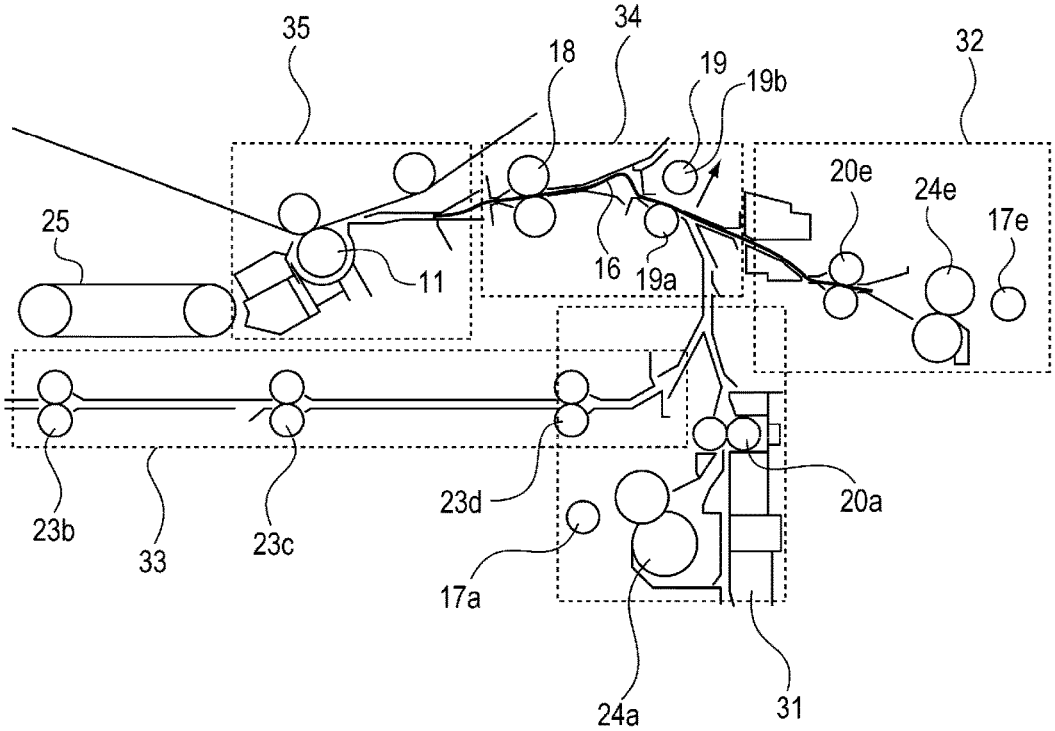

Even when the transfer material 16 is conveyed from the optional sheet-feeding conveyance portion 32, the situation is similar to when the transfer material 16 is conveyed from the main body sheet-feeding conveyance portion 31. When the transfer material 16 is conveyed to the registration corrector portion 34 as shown in FIG. 10A, a timing detection sensor (not shown) arranged immediately before the pair of registration rollers 18 whose rotation has been stopped detects the position of the transfer material. In accordance with the detected timing, the pair of pre-registration rollers 19 and the pair of intermediate conveying rollers 20*e* give a predetermined amount of feed to the transfer material 16. As a result, a loop is formed between the pair of registration rollers 18 and the pair of pre-registration rollers 19 to correct the skew feeding of the transfer material 16 as shown in FIG. 10B. Thereafter, the pair of registration rollers 18, the pair of pre-registration rollers 19, and the pair of intermediate conveying rollers 20*e* are re-driven at the same time in synchronism with the exposure of the laser scanner portions 1Y, 1M, 1C and 1K, and feed the transfer material 16 to the secondary transfer roller 11. In synchronism with the exposures of the laser scanner portions 1Y, 1M, 1C, and 1K, the position of the leading edge of the image with respect to the transfer material 16 is set so as to secure a predetermined amount. The separating operation of the pair of pre-registration rollers 19 is started when the transfer material has been conveyed for a distance of the predetermined amount X mm regardless of the length of the transfer material after the pair of registration rollers 18 is driven again as shown in FIG. 11A. Here, the predetermined amount X for conveying the transfer material for a distance of a predetermined amount is set to X=10 mm. Then, the transfer material 16 is conveyed to the secondary transfer portion 35 in the separated state of the pre-registration rollers as shown in FIG. 11B. This manner suppresses the influence of the loop reaction force of the transfer material 16 formed between the pair of registration rollers 18 and the pair of pre-registration rollers 19, so that conveyance is possible without the skew feeding and rotation, wrinkles and scratches of the transfer material.

Figure 12A:
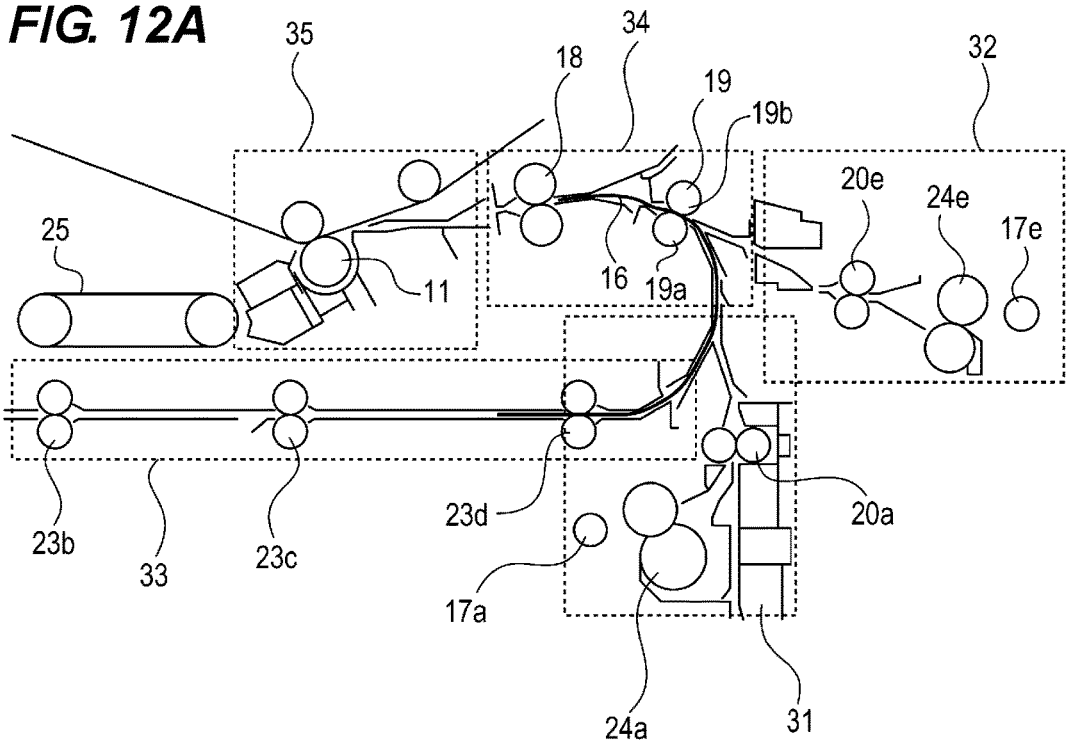
FIGS. 12A and 12B are illustrations of the sheet conveyance operation according to the first embodiment.
Figure 12B:
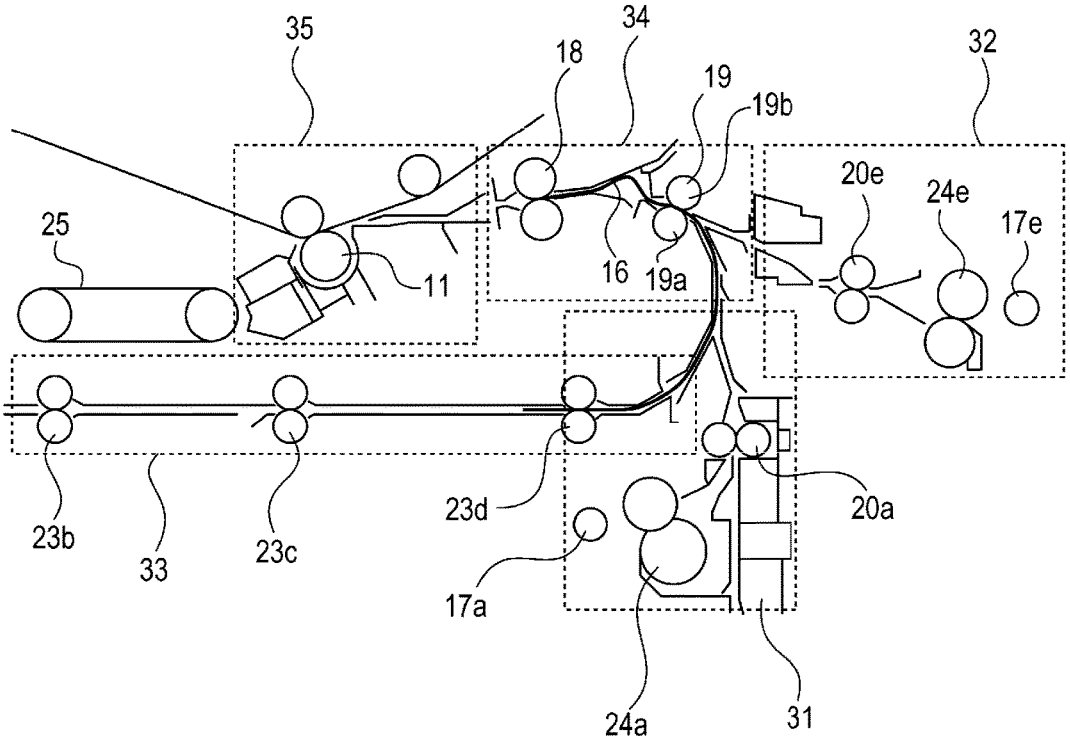

Next, a case where the transfer material 16 is conveyed from the duplex conveyance portion 33 will be described in detail. When the transfer material 16 is conveyed from the duplex conveyance portion 33, the separation timing of the pair of pre-registration rollers 19 is different from the timing when the transfer material 16 is conveyed from the main body sheet-feeding conveyance portion 31 or the optional sheet-feeding conveyance portion 32 depending on the sheet size. As shown in FIG. 12A, when the transfer material 16 is conveyed to the registration corrector portion 34, a timing detection sensor (not shown) disposed immediately before the pair of registration rollers 18 whose rotation has been stopped detects the position of the transfer material. In accordance with the detected timing, a predetermined amount of feed is given to the transfer material 16 by the pair of pre-registration rollers 19 and the pair of duplex conveying rollers 23*d*. As a result, as shown in FIG. 12B, a loop is formed between the pair of registration rollers 18 and the pair of pre-registration rollers 19 to correct the skew feeding of the transfer material. Thereafter, the pair of registration rollers 18, the pair of pre-registration rollers 19, and the pair of duplex conveying rollers 23*d* are re-driven at the same time in synchronism with the exposure of the laser scanner portions 1Y, 1M, 1C and 1K to feed the transfer material 16 to the secondary transfer roller 11. In synchronism with the exposures of the laser scanner portions 1Y, 1M, 1C and 1K, the position of the leading edge of the image with respect to the transfer material 16 is set so as to secure a predetermined amount. The process up to this point is similar to the case where the transfer material 16 is conveyed from the main body sheet-feeding conveyance portion 31 or the optional sheet-feeding conveyance portion 32.

After forming the loop of the transfer material as described above, the pair of registration rollers 18 is re-driven, but after that, the start timing of the separation operation of the pair of pre-registration rollers 19 is changed according to the length of the transfer material 16 in the conveyance direction to be optimized. Hereinafter, the start timing of the separation operation of the pair of pre-registration rollers according to the length of the transfer material in the conveyance direction will be described.

(5-1) Separation Control Drive Pattern 1

When the length of the transfer material 16 in the conveyance direction satisfies $c \leq (L-X) < b$, the separating operation of the pair of pre-registration rollers 19 is started at the time when the transfer material is conveyed for a distance of the predetermined amount X mm after the pair of registration rollers 18 is re-driven. Here, the predetermined amount X for conveying the transfer material for a distance of a predetermined amount is set to X=10 mm. The start of this separating operation is similar to the case where the transfer material 16 is conveyed from the main body sheet-feeding conveyance portion 31 or the optional sheet-feeding conveyance portion 32, as described above. The symbol L is the length of the transfer material 16 in the conveyance direction and the symbol b is the distance from the pair of registration rollers 18 to the pair of duplex conveying rollers 23*d* in the sheet conveyance path. Here, b=215 mm. The symbol c is the minimum compatible sheet size of the present image forming apparatus, and here, c=148 mm. That is, the case where the length of the transfer material in the conveyance direction satisfies $c \leq (L-X) < b$ means the case where the length of the transfer material is shorter than a first distance from the pair of registration rollers 18 to the pair of duplex conveying rollers 23*d* which is the pair of conveying rollers located upstream of and next to the pair of pre-registration rollers 19 in the sheet conveyance direction.

(5-2) Separation Control Drive Pattern 2

Figure 13A:
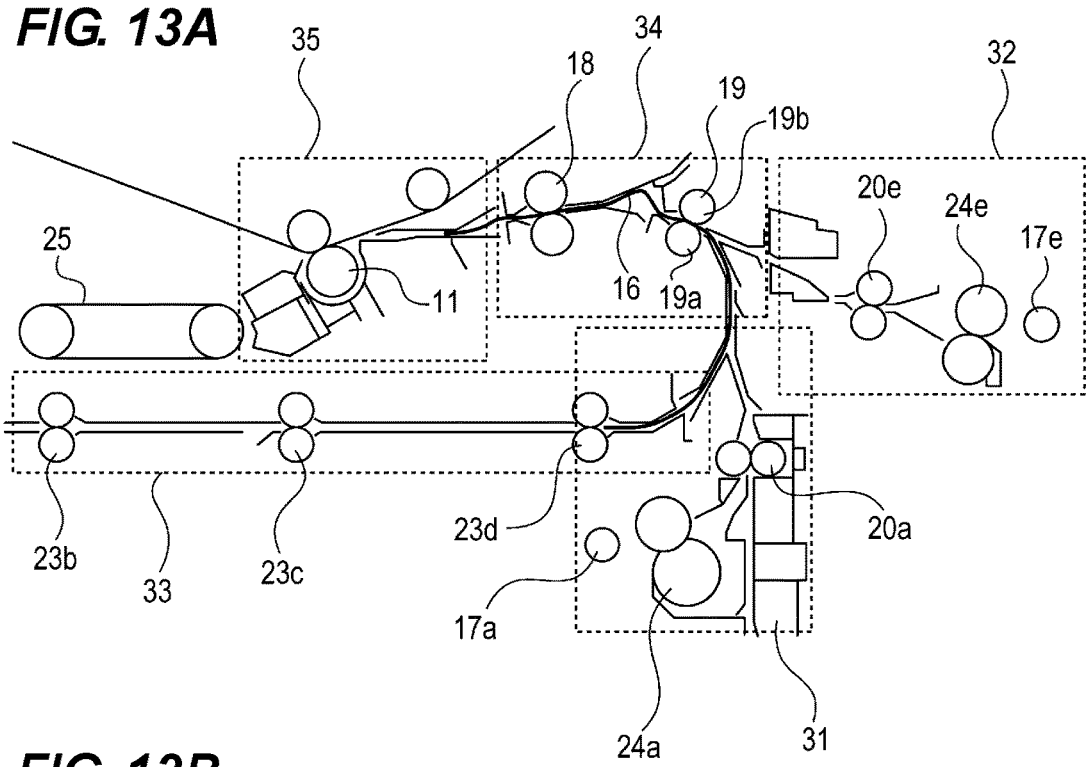
FIGS. 13A and 13B are illustrations of the sheet conveyance operation according to the first embodiment.
Figure 13B:
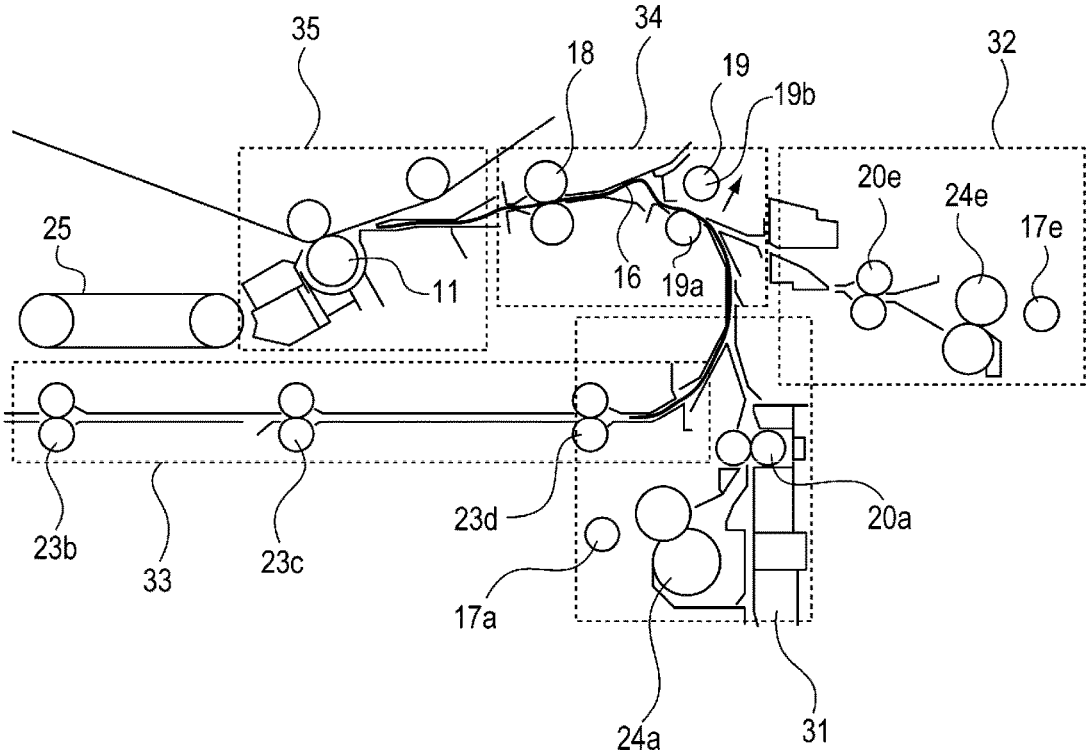

When the length of the transfer material 16 in the conveyance direction satisfies $b \leq (L-X) < a$, the separating operation of the pair of pre-registration rollers 19 is started at the timing when the rear edge of the transfer material 16 has travelled a distance of the predetermined amount X mm from the pair of duplex conveying rollers 23*d* as shown in FIG. 13A after the pair of registration rollers 18 is re-driven. The separation timing of the pair of pre-registration rollers 19 in the separation control drive pattern 2 is later than the separation control drive pattern 1. This start of the separating operation is different from the case where the transfer material 16 is conveyed from the main body sheet-feeding conveyance portion 31 or the optional sheet-feeding conveyance portion 32. It should be noted that the symbol a is the distance of the sheet conveyance path from the secondary transfer roller 11 to the pair of duplex conveying rollers 23*d*. That is, the distance a is a second distance a from the secondary transfer roller 11, which is a conveying roller located downstream of and next to the pair of registration rollers 18 in the sheet conveyance direction, to the pair of duplex conveying rollers 23*d*, and is longer than the first distance b. Here, a=325 mm. Then, as shown in FIG. 13B, the transfer material 16 is conveyed to the secondary transfer portion 35 in the separated state of the pre-registration rollers. This manner suppresses the influence of the loop reaction force of the transfer material 16 formed between the pair of registration rollers 18 and the pair of pre-registration rollers 19, so that sheet conveyance is possible without the skew feeding, rotation, wrinkles and scratches.

In the duplex conveyance portion 33, the sheet conveyance path is greatly bent compared to the sheet-feeding conveyance portions 31 and 32. Here, the bending of the sheet conveyance path is defined by an angle formed by the sheet conveyance direction of the pair of pre-registration rollers 19 and a sheet conveyance direction of the pairs of conveying rollers 20*a*, 20*e* and 23*d* located upstream of and next to the pair of pre-registration rollers 19 in the sheet conveyance direction. That is, the angle formed by the sheet-feeding conveyance portions 31 and 32 is an obtuse angle, whereas the angle formed by the duplex conveyance portion 33 is not an obtuse angle. Here, the sheet conveyance direction of each of pair of rollers means the tangential direction of the nip portion of each of the pair of rollers. The start timing of the separation operation of the pair of pre-registration rollers is changed depending on whether the angle formed by the tangential line of the nip portion of the pair of pre-registration rollers and the tangential line of the nip portion of each pair of conveying rollers on the upstream side is obtuse.

That is, when the sheet conveyance path is greatly bent (that is, when the angle formed by the sheet conveyance paths is not an obtuse angle) as in the duplex conveyance portion 33 as compared with the sheet-feeding conveyance portions 31 and 32, the transfer material 16 passes through the outside of the conveyance guide. Therefore, even when the pair of pre-registration rollers 19 is separated, there is no escape space of the loop formed at the time of skew correction and the loop reaction force of the transfer material 16 is not relaxed. Further, when the transfer material 16 passes through the sheet conveyance path which is greatly bent, the transfer material 16 is apt to receive slide friction resistance from the conveyance guide, and it becomes difficult to convey the transfer material 16 straight and stably. Therefore, when the sheet conveyance path is greatly bent like the duplex conveyance portion 33, it is desirable to set the separation timing of the pair of pre-registration rollers 19 to a time point after the transfer material passes through the pair of duplex conveying rollers 23*d*. That is, when the rear edge of the transfer material 16 has passed through the pair of duplex conveying rollers 23*d* disposed just before and upstream of the pair of pre-registration rollers 19, the rear edge of the transfer material 16 is in a free state. As a result, escape space of the loop formed for skew correction is generated, and in addition the restriction of the transfer material 16 by the pair of duplex conveying rollers 23*d* is eliminated, and thus the influence of the slide friction resistance received from the conveyance guide is reduced. It is desirable to start the separation of the pair of pre-registration rollers 19 after the transfer material has reached such a state.

(5-3) Separation Control Drive Pattern 3

Figure 14A:
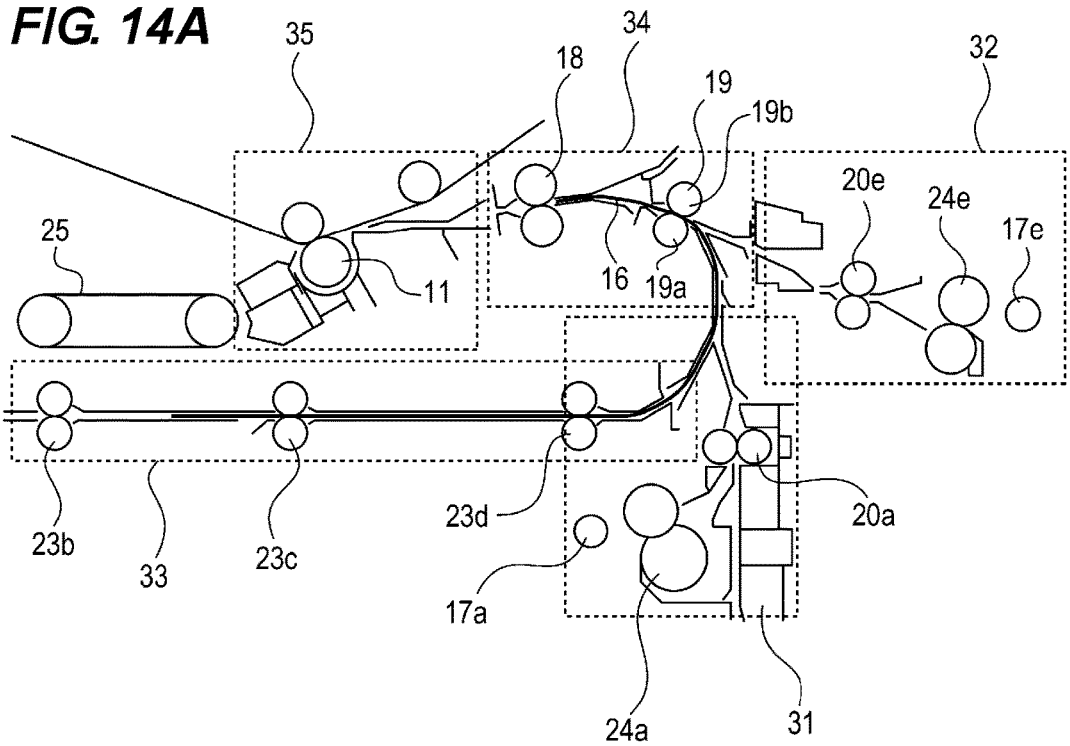
FIGS. 14A and 14B are illustrations of the sheet conveyance operation according to the first embodiment.
Figure 14B:
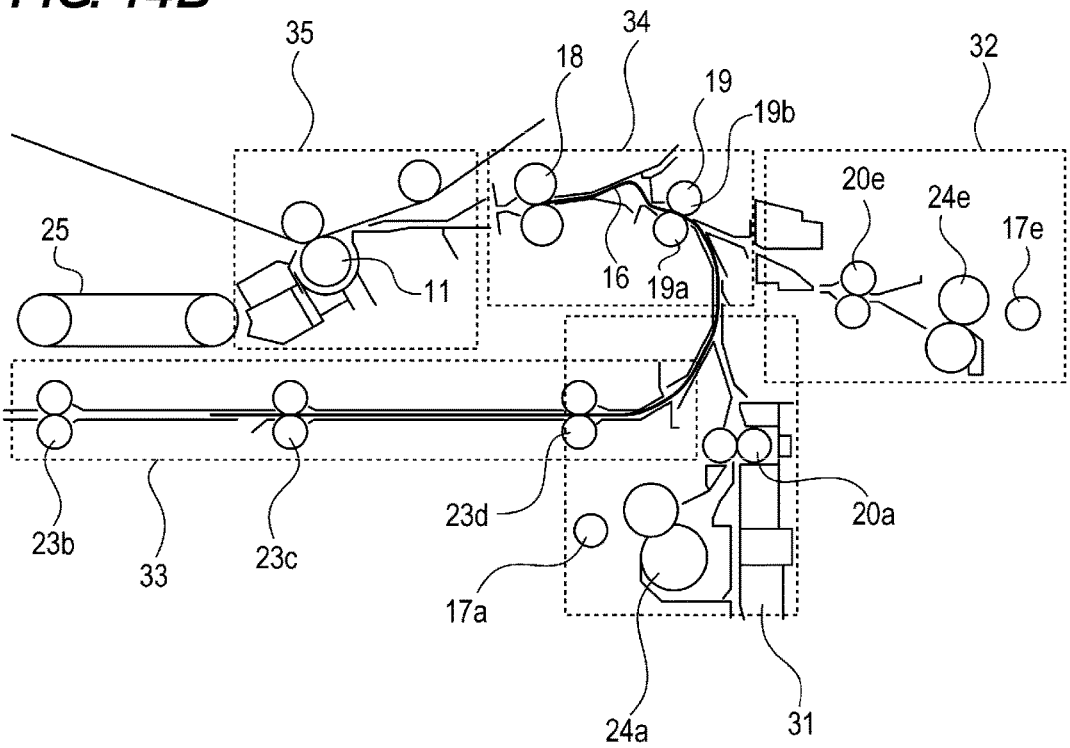
Figure 15A:
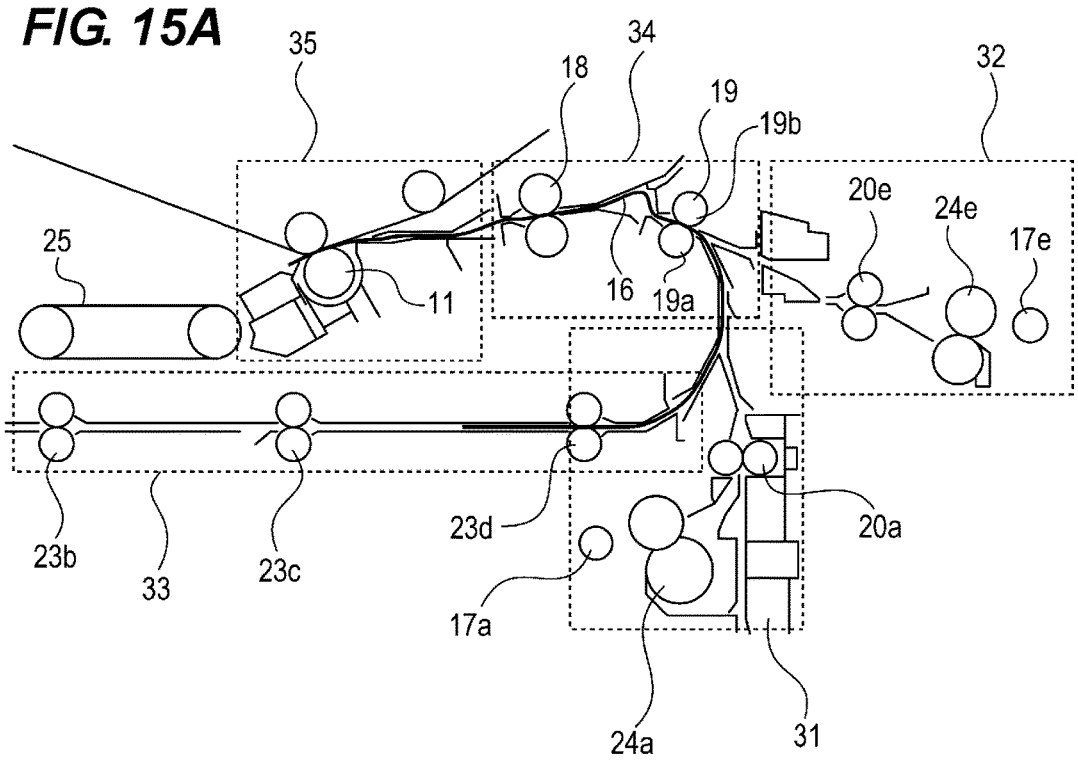
FIGS. 15A and 15B are illustrations of the sheet conveyance operation according to the first embodiment.
Figure 15B:
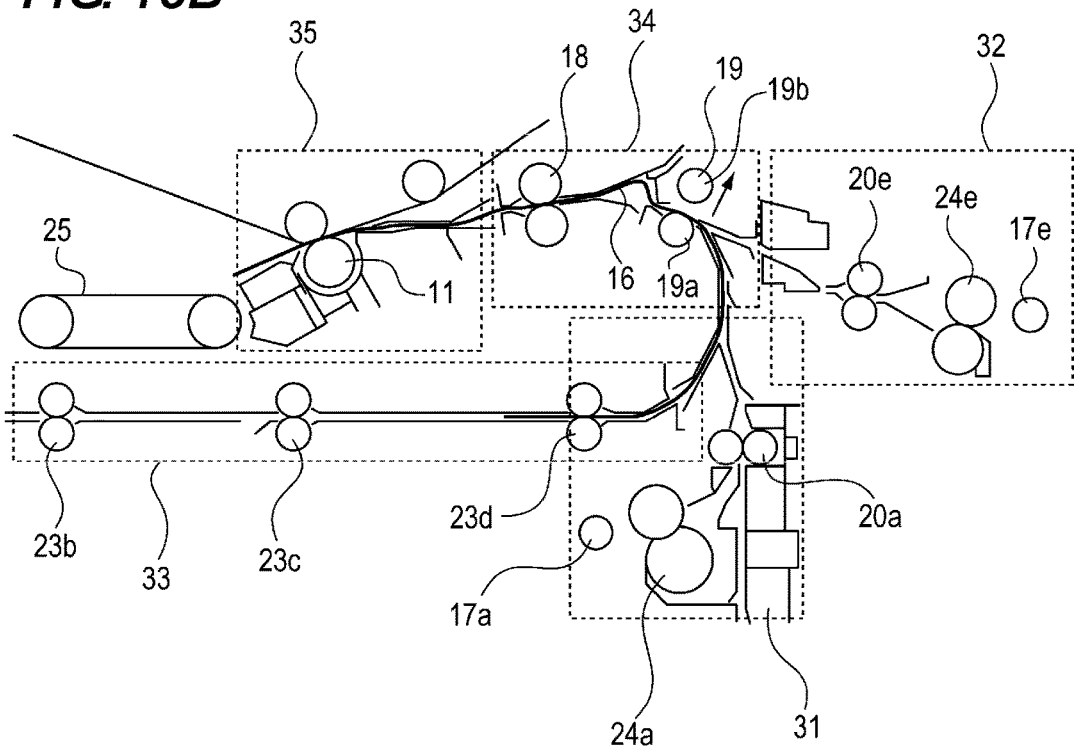

When the length of the transfer material 16 in the conveyance direction satisfies $a \leq (L-X)$, the separating operation of the pair of pre-registration rollers 19 is started at the timing when the leading edge of the transfer material 16 has travelled a distance of the predetermined amount X mm from the secondary transfer roller 11 as shown in FIGS. 14A, 14B and 15A after the pair of registration rollers 18 is re-driven. The separation timing of the pair of pre-registration rollers 19 in the separation control drive pattern 3 is later than that of the separation control drive pattern 1 or 2. It should be noted that the symbol a is the distance from the secondary transfer roller 11 to the pair of duplex conveying rollers 23*d* in the sheet conveyance path, and is the second distance longer than the first distance a as described above. Here, a=325 mm. Then, the transfer material 16 is conveyed in the separated state of the pre-registration rollers as shown in FIG. 15B. This manner suppresses the influence of the loop reaction force of the transfer material 16 formed between the pair of registration rollers 18 and the pair of pre-registration rollers 19, so that sheet conveyance is possible without the skew feeding, rotation, wrinkles and scratches.

Similarly to the above description, in the case where the sheet conveyance path is greatly bent like the duplex conveyance portion 33, even when the pair of pre-registration rollers 19 is separated, there is no escape space of the loop formed for skew correction, and the loop reaction force of the transfer material 16 is not relaxed. Further, the transfer material is apt to receive slide friction resistance from the conveyance guide, and it becomes difficult to convey the transfer material 16 straight and stably. Therefore, when the sheet conveyance path is greatly bent and the length of the transfer material 16 in the conveyance direction is longer than a predetermined length, the time point at which the rear edge of the transfer material 16 passes through the pair of duplex conveying rollers 23*d* is later than the time point at which the leading edge of the transfer material 16 reaches the secondary transfer roller 11. In this case, it is desirable to set the separation timing of the pair of pre-registration rollers 19 to be immediately after the material reaches the secondary transfer roller 11. Normally, the pair of registration rollers 18 and the secondary transfer roller 11 are set so that the roller nip pressure is high. Therefore, in the case where a plurality of (for example, two or more) pairs of high nip-pressure rollers 11 and 18 nips the transfer material 16, the slide friction resistance received from the conveyance guide is less influential even when the pair of pre-registration rollers 19 is separated.

It should be noted that the case where the sheet conveyance path is greatly bent is not limited to the duplex conveyance portion 33, and the angle formed by the sheet conveyance direction of the pair of pre-registration rollers 19 and the sheet conveyance direction of the pair of conveying rollers just before the pair of pre-registration rollers 19 is not obtuse, that is, the angle is smaller than approximately 90°. In such a case, there is a tendency that the slide friction resistance of the transfer material with the conveyance guide is particularly high. Therefore, as in the present embodiment, it is desirable to change the timing for separating the pair of pre-registration rollers 19 according to the length of the sheet in the conveyance direction to be optimized.

FIG. 17 shows a flowchart for determining the separation timing of the pair of pre-registration rollers 19 described above. The operation control of the pair of pre-registration rollers 19 described below is performed by the controller 48 shown in FIG. 6. The controller 48 not only controls the operation of the pair of pre-registration rollers 19 but also controls the operation of the registration corrector portion 34 including the operation control of driving and stopping the pair of registration rollers 18 shown in FIG. 18. When the print job is input, the sheet conveyance control setting of the registration portion is started (S101). Then, it is determined whether the sheet is conveyed from the duplex conveyance portion 33 or from others (the main body sheet-feeding conveyance portion 31, the optional sheet-feeding conveyance portion 32) (S102). Thereafter, the separation timing of the pair of pre-registration rollers 19 is determined according to the length of the transfer material 16 in the conveyance direction (S103 to S106). The detailed description is similar to that described with reference to FIGS. 12 to 15, and thus will be omitted. When the length of the transfer material in the conveyance direction is not the lengths of S103 to S105, it is an incompatible sheet, and thus the job is stopped (S107).

FIG. 18 shows a drive sequence diagram of the registration corrector portion 34. After conveying the preceding transfer material 16, the pair of registration rollers 18 stops once (P0). Thereafter, the pair of pre-registration rollers 19 conveys the subsequent transfer material 16 to the position just before the pair of registration rollers 18 (P1). Then, the transfer material 16 is sent to the pair of registration rollers 18 by the pair of pre-registration rollers 19 to form a loop for skew correction (P2). Thereafter, the pair of registration rollers 18 and the pair of pre-registration rollers 19 are driven in synchronism with the exposure timing to deliver the transfer material 16 to the secondary transfer portion 35 (P3). At that time, when the transfer material 16 from the main body sheet-feeding conveyance portion 31 or the optional sheet-feeding conveyance portion 32 is conveyed, or when the transfer material 16 is conveyed from the duplex conveyance portion 33 and the length of the transfer material 16 in the conveyance direction satisfies «$c \leq (L-X) \leq b$», the separation drive of the pair of pre-registration rollers 19 is driven according to the sequence of pattern 1 in the figure. At that time, when the sheet has been conveyed for a distance of the predetermined amount X mm from the pair of registration rollers 18, the separation drive of the pair of pre-registration rollers 19 is started (P4). When the transfer material 16 is conveyed from the duplex conveyance portion 33 and the length of the transfer material 16 in the conveyance direction satisfies «$b \leq (L-X) < a$», the separation drive of the pair of pre-registration rollers 19 is driven according to the sequence of pattern 2 in the figure. At that time, when the rear edge of the transfer material 16 has travelled a distance of the predetermined amount X mm from the pair of duplex conveying rollers 23*d*, the separation drive of the pair of pre-registration rollers 19 is started (P5). When the transfer material 16 is conveyed from the duplex conveyance portion 33 and the length of the transfer material 16 in the conveyance direction satisfies «$a \leq (L-X)$», the separation drive of the pair of pre-registration rollers 19 is performed according to the sequence of pattern 3 in the figure. At that time, when the leading edge of the subsequent transfer material 16 is conveyed for a distance of the predetermined amount X mm from the secondary transfer roller 11, the separation drive of the pair of pre-registration rollers 19 is started (P6). Thereafter, before the next transfer material 16 is conveyed to the registration corrector portion 34, the pair of pre-registration rollers 19 is brought into contact to each other (P7).

As described above, when the sheet conveyance path is greatly bent, when the separation timing of the pair of pre-registration rollers 19 is set to a time point immediately after the drive start timing of the pair of registration rollers 18 (after X mm conveyance in this case), there is a risk that the input skew feeding cannot be corrected sufficiently and the output skew feeding may be deteriorated on the contrary as shown in S1 of FIG. 16 due to the influence of the slide friction resistance of the conveyance guide and the like. Furthermore, the skew feeding may cause wrinkles, scratches on the transfer material 16 and a factor for sheet jamming. In the case of conveying the transfer material 16 from the duplex conveyance portion 33 which is a sheet conveyance path having a great bending, the separation timing of the pair of pre-registration rollers 19 is changed in accordance with the sheet size and optimized in the present embodiment. As a result, it is possible to reduce the influence of the reaction force of the loop for skew correction of the transfer material and the slide friction resistance with the conveyance guide, and as shown in S2 of FIG. 16, the output skew feeding is sufficiently corrected with respect to the input skew feeding. That is, after correcting the skew feeding in the registration corrector portion 34, the transfer material 16 can be stably delivered to the secondary transfer portion 35 as it is, and thus the image can be accurately transferred. Furthermore, the stress applied to the transfer material 16 is reduced, and wrinkles and scratches can be prevented.

[Other Embodiments]

In the above-described embodiment, the separation timing of the pair of pre-registration rollers after the skew correction is changed in accordance with the sheet conveyance path, and when further change is required (the case where the sheet is guided by the second conveyance path) the timing is changed in accordance with the length of the sheet in the conveyance direction. However, the present invention is not limited to this. A configuration may be adopted in which the separation timing of the pair of pre-registration rollers after the skew correction is changed and optimized in accordance with the length of the sheet in the conveyance direction.

Further, in the above-described embodiment, a printer is exemplified as the image forming apparatus provided with the sheet conveying apparatus, but the present invention is not limited thereto. Other image forming apparatuses such as a scanner, a copying machine, a facsimile apparatus, or other image forming apparatuses such as a multifunction peripheral combining these functions may be used. By applying the present invention to a sheet conveying apparatus used in these image forming apparatuses, similar effects can be obtained.

Further, in the above-described embodiment, the sheet conveying apparatus integrally provided in the image forming apparatus is exemplified, but the present invention is not limited to this. For example, the sheet conveying apparatus may be a detachably attached to the image forming apparatus, and similar effects can be obtained by applying the present invention to such a sheet conveying apparatus.

Further, in the above-described embodiment, a sheet conveying apparatus for conveying a sheet such as recording sheet as a recording object to the image forming portion has been exemplified, but the present invention is not limited to this. For example, even when the present invention is applied to a sheet conveying apparatus that conveys a sheet such as an original as a reading object to an image reading portion, similar effects can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-078998, filed Apr. 11, 2016, which is hereby incorporated by reference herein in its entirety.

What claimed is:

1. A sheet conveying apparatus comprising:

a first pair of conveying rollers configured to convey a sheet;

a second pair of conveying rollers against which a leading edge of the sheet conveyed by the first pair of conveying rollers is abutted so that a loop is formed on the sheet, the second pair of conveying rollers conveying the sheet together with the first pair of conveying rollers by rotating after the loop is formed on the sheet;

a separator configured to separate the first pair of conveying rollers from each other;

a first conveyance path configured to guide the sheet toward the first pair of conveying rollers;

a second conveyance path which is a path different from the first conveyance path and which is configured to guide the sheet toward the first pair of conveying rollers; and a controller configured to (a) determine by which of the first conveyance path and the second conveyance path the sheet with a loop is guided and (b) change a timing for the separator to separate the first pair of conveying rollers after the loop is formed on the sheet based on the determination of by which of the first conveyance path and the second conveyance path the sheet with the loop is guided.

2. The sheet conveying apparatus according to claim 1, wherein the first conveyance path is a conveyance path in which an angle formed by a sheet conveyance direction of a conveying roller located upstream of and next to the first pair of conveying rollers in a sheet conveyance direction and a sheet conveyance direction of the first pair of conveying rollers is obtuse, wherein the second conveyance path is a conveyance path in which an angle formed by the sheet conveyance direction of the conveying roller located upstream of and next to the first pair of conveying rollers in the sheet conveyance direction and the sheet conveyance direction of the first pair of conveying rollers is not obtuse, and wherein the controller is configured to control so that the separation timing of the first pair of conveying rollers is later when forming the loop on the sheet guided by the second conveyance path than when forming the loop on the sheet guided by the first conveyance path.

3. The sheet conveying apparatus according to claim 2, wherein the first conveyance path is a sheet-feeding conveyance path which conveys sheets separated one by one to the first pair of conveying rollers, and wherein conveyance path is a duplex conveyance path which conveys a sheet inversed after one-side printing to the first pair of conveying rollers for duplex printing.

4. The sheet conveying apparatus according to claim 1, further comprising an obtaining unit configured to obtain a length of the sheet in a sheet conveyance direction, wherein the controller is configured to change the separation timing of the first pair of conveying rollers based on the length of the sheet in the sheet conveyance direction obtained by the obtaining unit.

5. The sheet conveying apparatus according to claim 4, wherein the controller is configured to separate the first pair of conveying rollers at a time point when the first pair of conveying rollers which starts to rotate after forming the loop of the sheet has conveyed the sheet for a distance of a predetermined amount in a case where the length of the sheet in the sheet conveyance direction is shorter than a first distance from the second pair of conveying rollers to a pair of conveying rollers located upstream of and next to the first pair of conveying rollers in the sheet conveyance direction.

6. The sheet conveying apparatus according to claim 5, wherein the controller is configured to separate the first pair of conveying rollers after a rear edge of the sheet passes through the pair of conveying rollers located upstream of and next to the first pair of conveying rollers in the sheet conveyance direction, in a case where the length of the sheet in the sheet conveyance direction is longer than the first distance and shorter than a second distance from a conveying roller located downstream of and next to the second pair of conveying rollers in the sheet conveyance direction to the pair of conveying rollers located upstream of and next to the first pair of conveying rollers in the sheet conveyance direction.

7. The sheet conveying apparatus according to claim 6, wherein the controller is configured to separate the first pair of conveying rollers after the leading edge of the sheet reaches the conveying roller located downstream of and next to the second pair of conveying rollers in the sheet conveyance direction in a case where the length of the sheet in the sheet conveyance direction is longer than the second distance.

8. The sheet conveying apparatus according to claim 1, further comprising an obtaining unit configured to obtain a length of the sheet in a sheet conveyance direction, wherein the controller is configured to separate the first pair of conveying rollers which starts rotating after forming the loop of the sheet, at a time point when the sheet has been conveyed for a distance of a predetermined amount, in a case where the conveyance path which guides the sheet on which the loop is formed is the first conveyance path, and wherein the controller is configured to change the separation timing of the first pair of conveying rollers in accordance with the length of the sheet in the sheet conveyance direction obtained by the obtaining unit in a case where the conveyance path which guides the sheet on which the loop is formed is the second conveyance path.

9. The sheet conveying apparatus according to claim 1, wherein the controller is configured to set the separation timing of the first pair of conveying rollers by choosing between (a) a time point immediately after driving the first pair of conveying rollers after forming the loop on the sheet and (b) as determined by the controller, a time point after a rear edge of the sheet passes through a pair of conveying rollers located upstream of and next to the first pair of conveying rollers in a sheet conveyance direction.

10. The sheet conveying apparatus according to claim 1, wherein the controller is configured to set the separation timing of the first pair of conveying rollers by choosing between (a) a time point immediately after driving the first pair of conveying rollers after forming the loop on the sheet and (b) as determined by the controller, a time point after the leading edge of the sheet reaches a conveying roller located downstream of and next to the second pair of conveying rollers in a sheet conveyance direction.

11. The sheet conveying apparatus according to claim 1, wherein the first conveyance path and the second conveyance path are so configured that a conveyance resistance when the sheet passes through the second conveyance path is greater than a conveyance resistance when the sheet passes through the first conveyance path, and wherein the controller is configured to control so that the separation timing of the first pair of conveying rollers is later when forming the loop on the sheet guided by the second conveyance path than when forming the loop on the sheet guided by the first conveyance path.

12. An image forming apparatus comprising:

the sheet conveying apparatus according to claim 1; and an image forming portion which forms an image on the sheet conveyed by the sheet conveying apparatus.

13. The sheet conveying apparatus according to claim 1, wherein in a case where the controller determines that the sheet formed with the loop is guided by the first conveyance path, the separator separates the first pair of conveying rollers when the second pair of conveying rollers conveys the sheet for a first predetermined amount after the loop is formed on the sheet, and wherein in a case where the controller determines that the sheet formed with the loop is guided by the second conveyance path, the separator separates the second pair of conveying rollers when the second pair of conveying rollers conveys the sheet for a second predetermined amount larger than the first predetermined amount after the loop is formed on the sheet.

14. The sheet conveying apparatus according to claim 13, further comprising an obtaining unit configured to obtain a length of the sheet in a sheet conveyance direction, wherein even in a case that the controller determines that the sheet formed with the loop is guided by the second conveyance path, in a case that the length of the sheet which is obtained by the obtaining unit is shorter than a predetermined length, the separator separates the first pair of conveying rollers when the second pair of conveying rollers conveys the sheet for the first predetermined amount.

15. A sheet conveying apparatus comprising:

a first pair of conveying rollers configured to convey a sheet;

a conveying unit comprising a second pair of conveying rollers provided downstream of the first pair of conveying rollers in a conveying direction of a sheet, a loop being formed in the sheet when a leading edge of the sheet conveyed by the first pair of conveying rollers butts against the conveying unit;

a separator configured to separate the first pair of conveying rollers from each other; and a controller configured to execute a first controlling mode or a second controlling mode, wherein in the first controlling mode, the separator separates the first pair of conveying rollers when the second pair of conveying rollers conveys the sheet for a first predetermined amount after a loop is formed on the sheet, and wherein in the second controlling mode, the separator separates the first pair of conveying rollers when the second pair of conveying rollers conveys the sheet for a second predetermined amount larger than the first predetermined amount after a loop is formed on the sheet.

16. The sheet conveying apparatus according to claim 15, wherein in the second controlling mode, the separator separates the first pair of conveying rollers after, as determined by the controller, a rear edge of the sheet passes through a pair of conveying rollers located upstream of and next to the first pair of conveying rollers in the conveying direction of the sheet.

17. The sheet conveying apparatus according to claim 15, wherein in the second controlling mode, the separator separates the first pair of conveying rollers after forming the loop on the sheet and after, as determined by the controller, the leading edge of the sheet reaches a conveying roller located downstream of and next to the second pair of conveying rollers in the conveying direction of the sheet.

18. The sheet conveying apparatus according to claim 15, further comprising an obtaining unit configured to obtain a length of the sheet in a sheet conveyance direction, wherein the controller is configured to change the separation timing of the first pair of conveying rollers after forming the loop of the sheet according to the length of the sheet obtained by the obtaining unit.

19. The sheet conveying apparatus according to claim 15, further comprising:

a first conveyance path which guides the sheet toward the first pair of conveying rollers; and a second conveyance path which is a path different from the first conveyance path and guides the sheet toward the first pair of conveying rollers, wherein the controller executes the first controlling mode in a case that the controller determines that the sheet with the loop is guided by the first conveyance path, and wherein the controller executes the second controlling mode in a case that the controller determines that the sheet with the loop is guided by the second conveyance path.

20. An image forming apparatus comprising:

the sheet conveying apparatus according to claim 15; and an image forming portion which forms an image on the sheet conveyed by the sheet conveying apparatus.

* * * * *